United States Patent [19]

Metoki et al.

[11] Patent Number: 4,689,292

[45] Date of Patent: Aug. 25, 1987

[54] SILVER HALIDE PHOTOGRAPHIC RADIOGRAPHY LIGHT-SENSITIVE MATERIAL

[75] Inventors: Iku Metoki; Akio Suzuki; Eiji Yoshida; Kiyoshi Sato; Masumi Hosaka; Chika Honda, all of Hachioji, Japan

[73] Assignee: Konishiroku Photo Industry Co., Ltd., Tokyo, Japan

[21] Appl. No.: 794,641

[22] Filed: Nov. 4, 1985

[30] Foreign Application Priority Data

Nov. 11, 1984 [JP] Japan ..... 59-237134
Nov. 11, 1984 [JP] Japan ..... 59-237137

[51] Int. Cl.[4] ..... G03C 1/02

[52] U.S. Cl. ..... 430/567; 430/569; 430/570; 430/581; 430/583; 430/590

[58] Field of Search ..... 430/567, 569, 570, 581, 430/583, 590

[56] References Cited

U.S. PATENT DOCUMENTS 3,923,515 2/1975 Van Stappen ..... 430/396 X
4,446,228 1/1984 Honda et al. ..... 430/567

OTHER PUBLICATIONS

The Relationship Between Speed and Grain Size–by G. C. Farnell, The Journal of Photographic Science, vol. 17, pp. 116–125, 1969.

*Primary Examiner*—John E. Kittle
*Assistant Examiner*—Mukund J. Shah
*Attorney, Agent, or Firm*—Frishauf, Holtz, Goodman & Woodward

[57] ABSTRACT

A silver halide photographic light-sensitive material having high sensitivity and high covering power, particularly suitable for use in radiography comprising on a support, a silver halide emulsion layer having silver halide grains which have a grain-size distribution curve comprising at least two peaks of which in the mode form, the highest peak mode and another peak mode adjacent thereto stand leaving a space of 0.10μ to 0.30μ therebetween. An orthochromatic dye-sensitizer increases the sensitivity.

24 Claims, 7 Drawing Figures

SILVER HALIDE PHOTOGRAPHIC RADIOGRAPHY LIGHT-SENSITIVE MATERIAL

BACKGROUND OF THE INVENTION

The present invention relates to a silver halide photographic light-sensitive material having high sensitivity and high covering power, and more particularly to a silver halide photographic light-sensitive material for radiography use.

Silver halide photographic light-sensitive materials are required to have a high sensitivity and a high covering power; to be excellent in sharpness as well as in linearity of the shoulder and foot portions of the photographic characteristic curves thereof; and to be hardly desensitized when subjected to pressure. That is, with the recent progress of photographic technology, further increasing the photographic speed of silver halide photographic light-sensitive materials has been strongly demanded. For example, there have been demands for further increasing photographic speed so as to meet the respective needs for higher camera shutter speeds, for more rapidly processing color and black-and-white photographic papers, for electronically processing or simplifying the work in the graphic arts field, for attenuating X-ray exposure dose in the medical field, and so forth.

Above all, such demand is particularly strong in the medical radiographic field, which uses various techniques for the purpose of reducing the X-ray dose to which patients or radiographers are exposed. These techniques are essential for not merely attenuating the X-ray dose to which an individual is exposed but lessening the number of opportunities of group exposure.

In recent years, particularly with the increase in the number of medical X-ray checks, not only medical circles but also world opinion strongly call for reducing the exposure dose. In order to meet this demand, fluorescent intensifying paper screens, intensifying screens, fluorescent screens, and radiographic image intensifiers have been and are used, and efforts for improving these means and devices and increasing the photographic speed of photographic light-sensitive materials have been making remarkable progress in recent years. Also, closer medical examinations require highly accurate radiographic techniques. Since the larger the irradiating amount of X-rays, the higher the closeness of examinations, radiographic techniques using a large dose and also large-capacity X-ray generators have been developed. However, such radiographic techniques requiring a large X-ray dose, as stated above, can be rather counter to the need of reducing the exposure dose, and thus can be unacceptable. The radiographic field therefore needs a high photographic technology using a small X-ray dose. For this reason, it is indispensable to develop a photographic material capable of producing a high-quality image with a small X-ray dose, i.e., a further increased photographic speed-having photographic material.

On the other hand, future exhaustion of the resources of silver, principal raw material of silver halide photographic light-sensitive materials, is viewed with great anxiety. In addition, the price of silver can be quite unstable, for instance due to a steep rise in the price of petroleum. It is therefore desirable to reduce the amount of silver used for silver halide photographic light-sensitive materials as much as possible in order also to provide users with silver halide photographic light-sensitive materials at a stable price. To reduce the amount of silver, a covering power (optical density per unit amount of silver) improving technique is essential in addition to the photographic speed increasing technique.

Further, regarding the sharpness, for example, in radiographing affected parts of a living body, the radiographic image needs to be sharp and highly diagnosable also for the purpose of early detection of focuses and prevention of erroneous diagnoses; but conventional radiographic light-sensitive materials are not necessarily satisfactory for this purpose. An example of this is cerebroangiography, a recent widely-spread radiographing method. In this method a contrast medium is poured into a blood vessel of a brain to trace the momentary move of the medium to record the state of the entire cerebrovascular tract. The developed radiographic cerebrovascular image depicts the vascular tract on a high-density background; and in this instance, in order to find clearly the details of individual blood vessels, the shoulder portion (high-density region) of the characteristic curve of the radiographic image is required to be excellent in linearity as well as in sharpness.

In addition to the above problems, various light-sensitive materials may sometimes be desensitized by being subjected to various mechanical pressure prior to exposure (mechanical pressure prior to exposure causes desensitization that is recognized at the time of development). For example, medical X-ray film, since its size is large, tends to bend due to its own weight from its supported portion, thereby to forming film-bent troubles, so-called "knick marks," thereon, whereby pressure-desensitization troubles may occur. In recent years, mechanical transport system-applied automatic exposure/processing apparatus has been widely used as one of medical radiographic systems. In such apparatus, film is prone to be subjected to mechanical pressure, and particularly in a dry place in winter, pressure marks and pressure-desensitization troubles stated above tend to occur. And there is the possibility that such phenomena cripple medical diagnoses. Particularly, it is well known that the larger the grain size of and the higher the speed of a photographic light-sensitive material, the more does the light-sensitive material tend to form pressure-desensitization marks thereon. Examples of the use of thalium or dyes for the purpose of improving the pressure-desensitization problem are described in U.S. Pat. Nos.2,628,167, 2,759,822, 3,445,235 and French Pat. No. 2,296,204; and Japanese Patent Publication Open to Public Inspection (hereinafter referred to as Japanese Patent O.P.I. Publication) Nos.107129/1976 and 116025/1975; but some of them show inadequate improvements, some show conspicuous dye stains, and some others can hardly be deemed to satisfactorily bring out the advantageous nature of silver halide photographic light-sensitive materials utilizing mainly the ordinary surface sensitivity of large-average-grain-size high-speed silver halide grains. On the other hand, many attempts have been made to solve the pressure-desensitization problem by changing the physical properties of the binder of silver halide photographic light-sensitive materials, as described in U.S. Pat. Nos.3,536,491, 3,775,128, 3,003,878, 2,759,821 and 3,772,032; and Japanese Patent O.P.I. Publication Nos.3325/1978, 56227/1975, 147324/1975 and 141625/1976. However these techniques, although useful for solving the pressure-desensitization problem, are unable to make substantial improvements because they cause deterioration of such binder's physical properties as the tackiness of the film surface, dryness, scratch resistance, and the like.

Measures for increasing the photographic speed, raising the covering power, improving the characteristic curve and sharpness, and solving the pressure-desensitization problem, described above, have hitherto been studied in various ways; but it has been very difficult to satisfy all these problems. For example, a technique that grows large silver halide grains for use in a silver halide photographic light-sensitive material to thereby raise the photographic speed thereof is well-known as a typical photographic speed-raising technique. However, if the grains are grown like this, the covering power deteriorates (according to the report by G. C. Farnell in The Journal of Photographic Science, 17, 116 (1969)).

If, on one hand, grains having large covering power are used with a low silver halide concentration to obtain a maximum optical density necessary for a photographic light-sensitive material, the result is lowering of the photographic speed thereof, which is not desired.

Thus, the attempts to raise both the photographic speed and the covering power are inconsistent.

The method for raising the photographic speed without changing the grain size, i.e., the sensitizing method, includes a large variety of techniques. If a proper sensitization technique is used, the speed can be expected to be raised with the covering power maintained, Various techniques of this kind are reported which include, e.g., methods of incorporating a development accelerator such as a thioether into an emulsion; methods of supersensitizing a spectrally sensitized silver halide emulsion in combination with appropriate dyes; techniques of improving optical sensitizers; and other equivalent techniques. These methods, however, are hardly considered widely usable for high-speed silver halide photographic light-sensitive materials. That is, the silver halide emulsion for use in high-speed silver halide photographic light-sensitive materials, when any of the above methods is applied thereto in order to make chemical sensitization to the utmost, tends to produce fog during the storage thereof. And in silver halide photographic light-sensitive materials for radiography use in which as small an amount of gelatin as possible is used in order to enable rapid processing, the above method deteriorates the resulting image quality.

Further, in the field of medical radiography, light-sensitive materials of the orthochromatic type, sensitive to 540–550 nm wavelength region, obtained by orthochromatically sensitizing conventional light-sensitive materials of the regular type, sensitive to around 450 nm, have come to be generally used. Thus sensitized light-sensitive materials are made so highly sensitive and have so wide a wavelength region to which they are sensitized that the exposure X-ray dose can be reduced to minimize the influence thereof upon the human body. The dye sensitization is thus very useful means for increasing the photographic speed, but there are many problems yet to be solved; for example, there are cases where no adequate photographic speed can be obtained, depending on the type of emulsions,—such problems still remain unsolved.

On the other hand, silver halide photographic light-sensitive materials (there are those of two types: one type having light-sensitive emulsion layers on both sides of the support thereof and the other having a single emulsion layer on one side; hereinafter called "radiographic light-sensitive material(s)," including both types) are required to have an excellent sharpness, large information capacity, excellent graininess, and to be hardly desensitized by pressure, and subject to little deteriorating in image quality.

For example, as for medical radiographic light-sensitive materials, the higher the sharpness and the better the graininess, the more easily can the diagnosis be performed; and the larger the information capacity, the more advantageous because diagnosability is higher; and it is desirable that the sensitive material be hardly desensitized even by pressure. Thus, all diagnostic information could be precisely turned into an image, which image could be excellent in preservability with no change in its quality.

Thus, in radiographing affected parts of a living body in the medical field and for the purposes of early detection of focuses and preventing wrong diagnoses, it is required that the radiographic image be so sharp and information capacity be so large that the image is highly diagnosable. Conventional radiographic light-sensitive materials, however, are not necessarily satisfactory in this respect.

Namely, conventional radiographic light-sensitive materials are classified into three types: as shown in the characteristic curves of FIG. 6, the high gamma type represented by the curve (a), the low gamma type by the curve (b) and the medium gamma type by the curve (c). However, the high gamma type (a), although highly sharp because of the steep rise of its characteristic curve, has a poor information capacity in the low exposure region. In contrast, the low gamma type (b) can be used in the curve (b') formed by shifting the curve (b) in parallel leftward through the control of the X-ray dose. In this instance since photographic density D in the low exposure region can be raised, the information capacity can be large, but the inclination of the characteristic curve is so gentle and therefore the sharpness is so low that it is hard to perform the diagnosis. And in the medium gamma type (c), the information capacity in the low exposure region as well as the sharpness is no more than moderate.

Typical gamma values with respect to the densities of the respective types of radiographic light-sensitive materials are as given in Table 1. In addition, regarding the respective gamas in the table, in the characteristic curves shown in rectangular coordinates wherein unit lengths on the axes of the coordinates formed with optical density (D) and exposure (log E) are equal to each other, the gamma formed between the optical density points 0.05 and 0.30 is regarded as gamma 1 ($\gamma_1$), the gamma between the optical density points 0.50 and 1.50 as gamma 2 ($\gamma_2$) and the gamma between the optical density points 2.00 and 3.00 as gamma 3 ($\gamma_3$).

TABLE 1

| | $\gamma 1$ D = 0.05–0.30 | $\gamma 2$ D = 0.50–1.50 | $\gamma 3$ D = 2.00–3.00 |
|---|---|---|---|
| High gamma type | 0.83–0.96 | 2.6–3.0 | 2.8–3.5 |
| Medium gamma type | 0.73–0.82 | 2.4–2.7 | 2.5–3.0 |
| Low gamma type | 0.68–0.72 | 2.0–2.2 | 1.2–1.5 |

However, in the actual practice of radiographing with these conventional-type radiographic light-sensitive materials major problems occur. For instance, although the most frequently radiographed regions of living bodies in Japan are the chest, stomach and trabeculae of hands and feet, satisfactory radiographing of all of these regions cannot necessarily be carried out with the above-mentioned conventional radiographic light-sensitive materials.

First, referring to the chest, the important regions in reading a chest radiograph are the vascular tract in the lung field and the coronary artery behind the heart.

The lung field is a medium density region (D=1.3–1.5), and in order to read the vascular tract in the region, a high sharpness is necessary, while at the same time the coronary artery is in the low density region (D=0.05–0.30), so that a wide latitude is required; that is, it is essential that the exposure latitude be wide and adequate information be available from the image. However, conventional high gamma-type radiographic light-sensitive materials, although they can depict the lung field with high sharpness, depict the coronary artery only with very low density, so that they are substantially unable to contribute to diagnoses. In contrast, in the case where a low gamma-type radiographic light-sensitive material is used, although the coronary artery is depicted, the sharpness of the lung field region is poor.

Further, in the radiographing the stomach, since a contrast medium is used to improve its depiction, in conventional high gamma-type radiographic light-sensitive materials, when exposure is adjusted to the contrast medium's portion, the non-contrast-medium area, when developed, becomes solid black, thus making no contribution to diagnoses. In order to avoid such phenomenon, low gamma-type radiographic light-sensitive materials are mostly used. However, in the case of light-sensitive materials of this type, since the sharpness is lowered the diagnosability in the contrast medium-containing stomach wall region becomes deteriorated.

Also in the radiographing of trabeculae of hands and feet, etc., and soft parts (muscles or cartilage), conventional high gamma-type radiographic light-sensitive materials depict sharply the details of trabeculae, but make soft parts appear solid-black, thus failing diagnoses. In contrast, conventional low gamma-type radiographic light-sensitive materials depict sharply the soft parts, but show poor sharpness in the depiction of trabeculae.

And as for the pressure-desensitization problem of conventional radiographic light-sensitive materials, its improvement has been demanded as mentioned previously.

SUMMARY OF THE INVENTION

It is therefore a first object of the present invention to provide a silver halide photographic light-sensitive material which is free from the above-mentioned reciprocal problems and which has a high sensitivity and high covering power and is excellent in the sharpness as well as in the linearity of the shoulder and foot portions of the photographic characteristic curve thereof and hardly desensitized by pressure.

It is a second object of the present invention to provide a silver halide photographic light-sensitive material for radiography use, which has an excellent sharpness and wide exposure latitude in the low and high density regions so that the light-sensitive material, when used in the medical field, enables increased diagnosability; and which further is excellent in graininess, hardly desensitized by pressure, and shows almost no deterioration in the quality of the resulting image thereof, thus being usable advantageously.

The above objects of this invention are accomplished by a silver halide photographic light-sensitive material comprising a support having thereon an emulsion layer whose silver halide grains are of a grain-size distribution curve comprising two or more peaks of which, in the mode form, the highest peak mode and another peak mode adjacent thereto leave a space of not less than 0.10μ and less than 0.30μ therebetween.

DETAILED DESCRIPTION OF THE INVENTION

In the present invention, the grain size distribution curve of the silver halide grains of an emulsion layer comprises not less than two peaks (maximum). Of these peaks, in their modes, the highest peak mode A and another peak mode B adjacent thereto (if there are two adjacent peak modes, the higher one of them) are required to leave a space of from 0.10μ to 0.3μ therebetween (for the A and B, see the example shown in FIG. 1). If the space between the highest peak mode A and the peak mode B of the grain size distribution curve is less than 0.10μ, then it means that similar function-having grains are mixedly present, so that both photographic speed and covering power are hard to be improved simultaneously; and thus no advantages of both photographic speed and covering power can not be realized. On the other hand, if the space exceeds 0.30μ, then the form of the shoulder or foot part of the characteristic curve becomes softened to thereby result in a lower sharpness. This means that, if, for example, the smaller grain-size mode is spaced exceeding 0.30μ from the main grain-size mode, the grain size of the smaller mode is too small, thus leading to softening the gradient of the shoulder part to which the smaller grains contribute. If, in contrast, the larger grain-size mode is spaced exceeding 0.30μ from the main grain-size mode, the gradient of the foot part to which the larger grains contribute to is considered to be softened.

Particularly this space is desirable to be from 0.10μ to 0.25μ.

Figure 1:
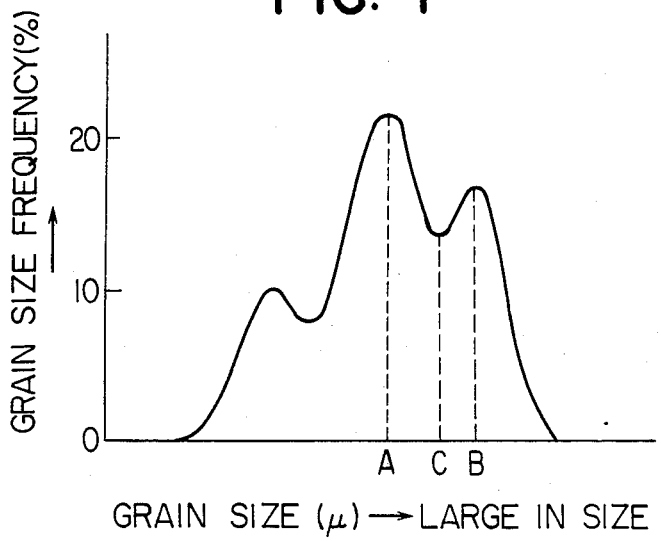
FIG. 1 is a graph showing silver halide grain size frequency, provided for explaining the construction of this invention.

One of the preferred embodiments of this invention is such that, if the grain size in the trough formed between the abovementioned highest peak mode A(μ) and an adjacent peak mode B(μ) (if there are two adjacent peak modes, the higher one of them) is regarded as C(μ), the frequency of C is from 90% to 5% of that of the mode A, and more preferably from 80% to 10% (for the A, B and C, see the example shown in FIG. 1). If this ratio is less than 5%, the gradient of the shoulder or foot part of the characteristic curve is softened, thus lowering the sharpness. If, on the other hand, this ratio exceeds 90%, advantages of both photographic speed and covering power can not be exhibited.

The proportion of the highest peak mode A to the peak mode B is desirably in the range of from 1:1 to 1:0.3, and more preferably from 1:0.9 to 1:0.4. If the proportion is too small, the meaning of the mixing becomes weakened, whereby covering power may sometimes not be raised. However, when the proportion is in the above range, satisfactory results can be obtained without hindrance.

In practicing this invention, either a single layer containing such different-mode silver halide grains or a construction of two or more layers constituting the same mode effect as a whole may be used. For example, in the case where two layers, a high-speed layer and a low-speed layer, are provided, the two layers may be composed so as to have the above mode difference as a whole.

If this invention is adopted, it is possible to obtain a preferred characteristic curve which is such that, in a characteristic curve in rectangular coordinates formed with coordinate axes with their unit lengths equal to each other for optical density (D) and exposure (log E), the gamma ($\gamma_1$) formed between the optical density points 0.05 and 0.30 is from 0.36 to 0.65, the gamma ($\gamma_2$) formed between the optical density points 0.50 and 1.50 is from 2.7 to 3.3, and the gamma ($\gamma_3$) formed between the optical density points 2.00 and 3.00 is from 1.5 to 2.5. A silver halide light-sensitive material of such a characteristic curve is excellent in the graininess as well as in the sharpness. If this is used in radiography, because its sharpness is so high and its latitude in the low and high density areas is so wide, all necessary regions of a living body can be satisfactorily radiographed, the diagnosability in the medical field can be raised, and, further, it is excellent in graininess, hardly desensitized by pressure, and its resulting image quality is hardly deteriorated with time. Therefore a very advantageously usable light-sensitive material can be provided.

There are various methods of producing a silver halide light-sensitive material having such characteristic curve. Moreover, it can be obtained by any method such as by the use of a monodisperse emulsion, polydisperse emulsion or core/shell-type monodisperse emulsion, single use of a core/shell-type polydisperse emulsion alone or combined use of two or more different core/shell-type polydisperse emulsions, control of the grain size or grain size distribution, optimization of the silver halide crystal habit, control of the hardening degree of an emulsion, addition of a development accelerator, addition of a development restrainer, or the like.

In another embodiment, the grains obtained by any arbitrary one of the above means are dye-sensitized by use of at least one compound selected from the group of those compounds having the hereinafter described Formulas [I], [II] and [III], whereby the above-described characteristic curve can also be obtained. In this instance, this can be accomplished preferably by use of two or more different monodisperse grains or polydisperse grains. These grains may also be chemically sensitized, and in which case the different grains may be either separately subjected to appropriate chemical sensitizations or mixed and then chemically sensitized. In practicing this invention the former is rather preferred.

When adopting the embodiment using a compound of any one of Formula [I], [II] or [III], the sensitive material is orthochromatically sensitized, so that it is further improved with respect to its graininess and desensitization by pressure. That is, the regular-type emulsion, because large-size grains for the foot portion which needs a high speed we used it, is poor in graininess as well as in the pressure-desensitization characteristic, while in the orthochromatic-type emulsion, since it is highly sensitized by dye sensitization, the silver halide grains to be used can be made much smaller. Consequently the graininess as well as the pressure-desensitization characteristic can be further improved.

In addition, the gammas herein used are ones obtained from a characteristic curve drawn in rectangular coordinates formed with equal-unit-length coordinate axes for optical density (D) and logarithmic exposure (log E). The foregoing $\gamma_1$ represents the inclination of a straight line by the connection between the point of the base (support) density plus fog density plus 0.05 and the point of the base density plus fog density plus 0.30; $\gamma_2$ represents the inclination of a straight line by the connection between the point of the base density plus fog density plus 0.50 and the point of the base density plus fog density plus 1.50; and $\gamma_3$ represents the inclination of a straight line by the connection between the point of the base density plus fog density plus 2.00 and the point of the base density plus fog density plus 3.00. Further, if numerically expressed, the angles formed when these straight lines intersect the exposure axis (axis of abscissa) are regarded as $\theta_1$, $\eta_1$ and $\theta_3$, the $\gamma_1$, $\gamma_2$ and $\gamma_3$ mean tan $\theta_1$, tan $\theta_2$ and tan $\theta_3$, respectively. The particularly preferred embodiment is such that, when the light-sensitive material is processed under the following processing condition, a characteristic curve of the $\gamma_1$, $\gamma_2$ and $\gamma_3$ can be obtained in rectangular coordinates.

Processing Condition

The light-sensitive material is processed by use of the following Developer-1 in accordance with the following steps in a roller transport-type automatic processor.

| | Processing tem. | Processing time |
|---|---|---|
| Developing | 35° C. | 30 sec. |
| Fixing | 34° C. | 20 sec. |
| Washing | 33° C. | 18 sec. |
| Drying | 45° C. | 22 sec. |

| Developer-1 | |
|---|---|
| Potassium sulfite | 55.0 g |
| Hydroquinone | 25.0 g |
| 1-phenyl-3-pyrazolidone | 1.2 g |
| Boric acid | 10.0 g |
| Potassium hydroxide | 21.0 g |
| Triethylene glycol | 17.5 g |
| 5-methyl-benzotriazole | 0.04 g |
| 5-nitrobenzimidazole | 0.11 g |
| 1-phenyl-5-mercaptotetrazole | 0.015 g |
| Glutaroacetaldehyde hydrogensulfite | 15.0 g |
| Glacial acetic acid | 16.0 g |
| Potassium bromide | 4.0 g |
| Water to make 1 liter | |

Such a characteristic curve can be obtained, for example, by the following photosensitometry: As for a radiographic light-sensitive material, exposure is made in the manner that a radiographic light-sensitive material comprising a transparent support having on both sides thereof light-sensitive emulsion layers (or on one side thereof a light-sensitive emulsion layer) is put in between two optical wedge plates which are arranged with their density gradients facing mirror-symmetrically to each other; and both sides of the light-sensitive material are exposed for 10 seconds to lights in the same quantity coming from light sources of 4,500° K. set opposite to each other with the light-sensitive material therebetween. The exposed light-sensitive material is then processed in a roller transport-type automatic processor in accordance with the foregoing procedure. For fixing, any fixer solution may be used as long as it is an acid hardening fixer; for example, Sakura XF (manufactured by Konishiroku Photo Industry Co., Ltd.) and the like may be used.

No particular restrictions are put on the silver halide emulsion to be used in the present invention but one preferred embodiment is the use of regular structure or configuration-having silver halide grains. The "regular grains" herein means a silver halide emulsion containing silver halide grains, 80% by weight or by the number of grains of which have regular configuration. Also, the regular structure or configuration-having silver halide grains mean those not growing unisotropically like twin but growing isotropically, and being in the cubic, tetradecahedral, octahedral, spherical or the like form. Methods for the preparation of such regular silver halide grains are of the prior art, and described in, e.g., J. Phot. Sci. & Eng., 5, 332 (1961); Ber. Bunsenges. Phys. Chem. 67, 949 (1963); Intern. Congress Phot. Sci. Tokyo (1967), and the like. Such regular silver halide grains can be obtained by the control of the reaction condition at the time of growing silver halide grains by the simultaneously mixing method. In the simultaneously mixing method, silver halide grains are produced by adding both a silver nitrate solution and a halide solution each in almost equivalent quantity step by step to an aqueous protective colloid solution with vigorous stirring.

The supply of silver and halide ions is desirably to made so as to gradually, continuously or step by step increase the growth rate of the silver halide grains at the limit growth rate or within the tolerable range of supplying the silver halide necessary and enough for the growth of the existing grains alone under the condition of not dissolving the existing crystal grains with the growth of crystal grains nor allowing the generation or growth new grains. Methods for the above-mentioned gradual increase in the growth rate are described in Japanese Patent Examined Publication Nos.36890/1973 and 16364/1977, and Japanese Patent O.P.I. Publication No.142329/1980.

The limit growth rate varies according to temperature, pH, pAg, stirring rate, the composition of silver halide grains, solubility, grain size, space between the grains, crystal habit, the type and concentration of protective colloid and the like; and can be found on as experimental basis by the microscopic observation of emulsion particles suspension in a liquid phase, turbidity measurement or the like.

In practicing the present invention, when an emulsion contains the above-mentioned regular silver halide grains, the emulsion may also contain a certain quantity of irregular silver halide grains. In the case where such irregular grains are present, they should be not more than about 50% by weight of by the number of grains. In a preferred embodiment, regular silver halide grains account for at least about 60–70% by weight.

Another preferred embodiment of this invention is to use a substantially monodisperse emulsion in a silver halide emulsion layer of this invention.

The monodisperse emulsion suitably usable in this invention is a silver halide emulsion which, when the average grain diameter is measured in usual manner by, e.g., the method reported in Trivelli and Smith, "The Photographic Journal," 79, 330–338 (1939), 95% by weight or by the number of grains of the total grains are those of sizes in the range of the average grain size ±40%, and preferably in the range of the average grain size ±30%. Such monodisperse emulsion grains can be prepared by the simultaneously mixing method as in the case of regular silver halide grains. Methods for the preparation of such monodisperse emulsion are in the prior art, and described in, e.g., J. Phot. Sci., 12, 242–251 (1963), Japanese Patent Examined Publication Nos.36890/1973 and 16364/1977, and Japanese Patent O.P.I. Publication Nos.142329/1980 and 49938/1983.

In order to obtain the above-described monodisperse emulsion, it is desirable that, particularly seed crystals be used as growth nuclei, and silver and halide ions be supplied to the nuclei to grow the grains.

The wider the grain-size distribution of the seed crystals, the wider the grain size distribution of the grown grains. Accordingly, in order to obtain a monodisperse emulsion, in the stage of the seed crystals it is desirable to use those of narrow-width grain size distribution.

In the practice of this invention, the silver halide grains to be used in the silver halide emulsion may be prepared by the application of the neutral process, acid process, ammoniacal process, orderly mixing process, inverse mixing process, double-jet process, controlled double-jet process, conversion process, core/shell process, and the like, as described in, e.g., T. H. James, "The Theory of the Photographic Process," 4th ed., published by Macmillan, 38–104 (1977). Regarding the composition of silver halide, any emulsion of silver chloride, silver bromide, silver iodobromide, silver chloroiodobromide, etc., may be used. Of these the most preferred emulsion is a not more than 10% silver iodide-containing silver iodobromide emulsion.

No particular restrictions are put on the silver halide grain size but the size should be preferably from 0.1 to 3μ and more preferably from 0.3 to 2μ. It is desirable that the silver halide grain or silver halide emulsion contain at least one of the salts (water-soluble salts) of iridium, thalium, palladium, zinc, nickel, cobalt, uranium, thorium, strontium, tungsten and platinum. The salt content of the emulsion is preferably from $10^{-7}$ to $10^{-3}$ moles per mole of silver. The particularly preferred embodiment is that the emulsion contains at least one of salts of thalium, palladium and iridium. These may be used alone or in a mixture. And their adding position (point of time) is discretional. Thus, the improvement on the characteristic to flash exposure, prevention of desensitization by pressure, prevention of fading of the latent image, sensitization and other effects can be expected.

According to another preferred embodiment of this invention, the silver halide grain desirably has therein-side a localized part where silver iodide whose concentration is as high as at least 20% is present locally.

In this instance, the localized part of the grain is desirably located as much inner away from the external surface as possible, and particularly desirably present at a point more than 0.01 μm away from the external surface.

The localized part is allowed to be in the stratified form inside the grain, and also allowed to be of the so-called core/shell structure of which the entire core forms the localized part. In this instance, part or the whole of the core portion of the grain excluding the shell portion having a thickness of more than 0.01 μm from the external surface is desirably the localized part, in which concentration of silver iodide is more than 20 mole %.

In addition, the silver halide of the localized part is desirable to be in the concentration range of from 30 to 40%.

The outside of such the localized part is usually covered with a silver halide containing less silver iodide. That is, in a preferred embodiment, the shell portion having a thickness of not less than 0.01μ from the external surface, particularly from 0.01 to 1.5 μm, is formed with a silver halide (usually silver bromide) which contains a smaller amount of silver iodide than that of the localized part or which contains no silver iodide at all.

In this invention, the formation of such a localized part containing silver iodide whose concentration is as high as at least 20% in the internal part of the grain (preferably the internal part is not less than 0.01 μm away from the external surface) is desirably made by a method using seed crystals, but may also be made by a method using no seed crystals.

Where no seed crystals are used, there is supplied to a protective gelatin-containing reaction liquid phase (hereinafter called "mother liquid"), because there is no silver halide to serve as growth nuclei prior to starting ripening, silver ions and halide ions containing iodide ions whose concentration is as high as at least 20 mole % to thereby form growth nuclei. And the supply is further continued to grow grains from the growth nuclei. Finally a silver halide which contains a smaller amount of silver iodide than that of the localized part or which contains no silver iodide at all is used to form a shell layer having a thickness of not less than 0.01 μm.

When seed crystals are used, at least 20 mole % silver halide on the seed crystal alone is formed and this may be then covered with a shell layer. Alternatively, the quantity of the silver iodide on the seed crystal falls under the range of from zero up to 10 mole % and at least 20 mole % silver iodide is formed inside the grain in the process of growing the seed crystal and this may be then covered with a shell layer.

In this invention, the silver iodide is desirably accounts for from 0.5 to 10 mole % of the whole silver halide of the grain and in that case, in the former method the seed crystal size becomes too large as compared to that in the latter, and thus the grain size distribution becomes wider. The one having a multilayer structure as in the latter is preferred in this invention.

In practicing this invention, an embodiment which is such that, in the course of the above-described growing of the grain prior to chemical sensitization, the pAg of the protective colloid-containing mother liquid is at least 10.5 can be suitably adopted. The particularly preferred is such that the grain is rendered to encounter even once with an atmosphere of bromide ions of as much high pAg as more than 11.5. Thus the (111) face is increased to round the grain, whereby the effect of this invention can be further raised. The (111) face of the grain is desirably accounts for more than 5% of the whole surface area of the grain.

In this instance, the increased proportion of the (111) face (proportion between before and after the encounter with the pAg atmosphere of more than 10.5) should be more than 10%, preferably from 10 to 20%.

Which of the (111) face and the (100) face covers the external surface of the grain and in what manner the proportion of the (111) face to the (100) face should be determined are described in the report by Akira Hirata in the "Bulletin of the Society of Scientific Photography of Japan" No.13, pp 5–15 (1963).

In this invention, if, in the course of the growth of the grain before chemical sensitization, the grain encounters an atmosphere of a pAg of more than 10.5 of the protective colloid-containing mother liquid once, then whether or not the (111) face increases by more than 5% can be easily ascertained by the Hirata's measuring method.

In this instance, the time when the above pAg is applied is prior to chemical sensitization, and preferably during the period between the point of time when silver ions are added for the purpose of the growth of the silver halide grain and the point of time just before the desalting process, particularly preferably at a point of time after completion of the addition of silver ions and before the desalting process which is usually performed prior to chemical sensitization. This is because a narrow-width-grain-size-distribution monodisperse emulsion is easily obtainable.

In addition, the ripening in the atmosphere of a pAg of more than 10.5 is desirable to be performed for more than two minutes.

Under the control of the pAg the (111) face increases by more than 5% to thereby round the form of the grain, whereby preferred grains having the (111) face accounting for more than 5% of the whole external surface of the grain can be obtained.

When practicing this invention, if the average grain size of the emulsion containing the respective peak modes is larger than 3.0μ, the deterioration of the graininess can become conspicuous, and the sensitizing effect cannot necessarily be obtained. If, on the other hand, the average grain size is smaller than 0.2μ, the deterioration of the photographic speed can become conspicuous. The average grain size of silver halide grains is preferably from 0.4 to 1.7μ.

In the present invention, in the case where two or more different average grain size-having silver halide emulsions are used, the silver halide compositions of the respective emulsions are allowed to be the same or different.

The number of the types of the silver halide emulsions which differ in the average grain size to be used in combination is desirably not more than five. If more than five, the respective silver halide grain size distributions are closely overlapped, so that satisfactory control can not necessarily be carried out. Therefore not more than three types are desirable.

The term "average grain size $\bar{r}$" used herein, when the silver halide grain is spherical, means its diameter, and, when the grain is in a different form than a cube or sphere, means the average value of diameters obtained when converting its projection image into circular images, and if each individual grain diameter is regarded as $r_i$ and if the number of grains as $n_i$, then the $\bar{r}$ is as defined by the following formula:

$$\bar{r}=\Sigma n_i r_i/\Sigma n_i$$

Regarding the monodisperse silver halide (grains) in this invention, when, in the standard deviation S of the silver halide grain size distribution and its average grain size $\bar{r}$, the standard deviation S as defined by the following formula is divided by the average grain size $\bar{r}$, its value is desirable to be equal to or less than 0.20.

$$S = \sqrt{\frac{\Sigma (\bar{r} - r_i)^2 n_i}{\Sigma n_i}}$$

$$\frac{S}{\bar{r}} \leqq 0.20$$

Further, the $S/\bar{r}$ is particularly desirable to be $\leqq 0.15$.

A preferred embodiment of the present invention is the addition of at least one sensitizing dye selected from the group of those compounds having the following Formulas [I], [II] and [III] to a silver halide emulsion layer of this invention.

When adopting an embodiment of using any one of Formula [I], [II] or [III] compound, the emulsion is orthochromatically sensitized, and therefore the emulsion can be further improved particularly with regard to the pressure-desensitization characteristic. That is, in an emulsion of the regular type, since large grains are used for its foot portion which has to be highly sensitive, the pressure-desensitization characteristic is poor; while in an orthochromatic one such as the above, because of being dye-sensitized to be highly sensitive, the silver halide grains used can be made much smaller. As a result, the pressure-desensitization characteristic can be further improved.

Formulas [I], [II] and [III] are as follows:

Formula [I]

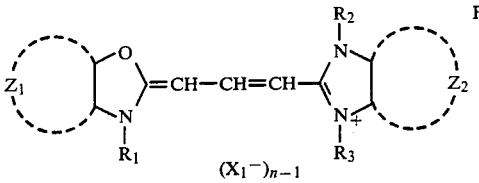

wherein $R_1$, $R_2$ and $R_3$ each is a substituted or unsubstituted alkyl, alkenyl or aryl group, provided at least one of the $R_1$ and $R_3$ is a sulfoalkyl or carboxyalkyl group; $X_1^-$ is an anion; $Z_1$ and $Z_2$ each is a group of nonmetallic atoms necessary to complete a substituted or unsubstituted benzene ring; and n is an integer of 1 or 2, provided n is 1 when an intramolecular salt is formed.

Formula [II]

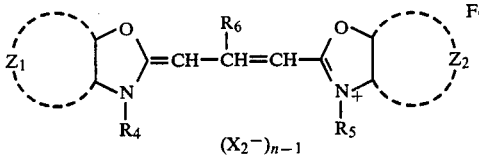

wherein $R_4$ and $R_5$ each is a substituted or unsubstituted alkyl, alkenyl or aryl group, provided at least one of the $R_4$ and $R_5$ is a sulfoalkyl or carboxyalkyl group; $R_6$ is a hydrogen atom, a lower alkyl or aryl group; $X_2^-$ is an anion; $Z_1$ and $Z_2$ each is a group of nonmetallic atoms necessary to complete a substituted or unsubstituted benzene ring; and n is 1 or 2, provided n is 1 when an intramolecular salt is formed.

Formula [III]

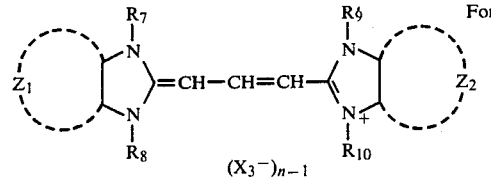

wherein $R_7$ and $R_9$ each is a substituted or unsubstituted lower alkyl group; $R_8$ and $R_{10}$ each is a lower alkyl, hydroxyalkyl, sulfoalkyl or carboxyalkyl group; $X_3^-$ is an anion; $Z_1$ and $Z_2$ each is a group of nonmetallic atoms necessary to complete a benzene ring; and n is 1 or 2, provided n is 1 when an intramolecular salt is formed.

When any of those compounds having Formula [I], [II] and [III] is used in a silver halide emulsion of this invention, at least 95% by weight or by the number of grains of the silver halide grains contained in the silver halide emulsion are desirably in the grain size range of the average grain size ±40%.

Subsequently, those compounds having Formulas [I], [II] and [III] will be further illustrated.

In Formula [I], the substituted or unsubstituted alkyl group represented by each of the $R_1$, $R_2$ and $R_3$ includes lower alkyl groups such as methyl, ethyl, n-propyl, butyl and the like; the substituted alkyl group represented by each of the $R_1$, $R_2$ and $R_3$ includes vinylmethyl group, hydroxyalkyl group such as 2-hydroxyethyl, 4-hydroxyethyl, etc., acetoxyalkyl group such as 2-acetoxyethyl, 3-acetoxybutyl, etc., carboxyalkyl group such as 2-carboxyethyl, 3-carboxypropyl, 2-(2-carboxyethoxy)ethyl, etc., and sulfoalkyl group such as 2-sulfoethyl, 3-sulfopropyl, 3-sulfobutyl, 4-sulfobutyl, 2-hydroxy-3-sulfopropyl, etc.; and the alkenyl group represented by each of the $R_1$, $R_2$ and $R_3$ includes butenyl, octenyl, oleyl, and the like; and further the aryl group represented by each of the $R_1$, $R_2$ and $R_3$ includes phenyl, carboxyphenyl, and the like; provided, however, that, as previously mentioned, at least one of the $R_1$, $R_2$ and $R_3$ is a sulfoalkyl or carboxyalkyl group.

Also, in Formula [I], the anion represented by the $X_1^-$ includes, e.g., a chlorine ion, bromine ion, iodine ion, thiocyanic acid ion, sulfuric acid ion, perchloric acid ion, p-toluenesulfuric acid ion, ethylsulfuric acid ion, and the like.

The following are typical examples of those compounds having Formula [I], but the present invention is not restricted by the examples.

Exemplified Compounds (1)

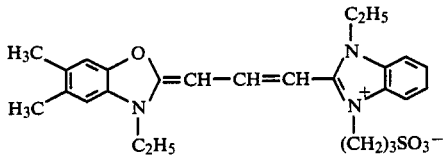

(2)

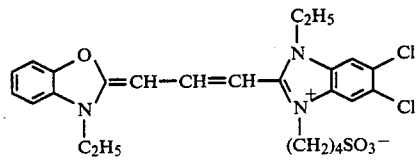

-continued
Exemplified Compounds
(3)
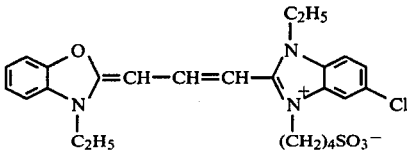
(4)
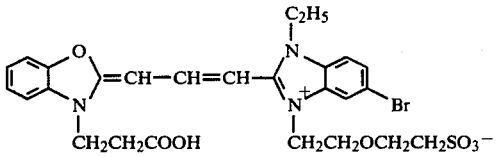
(5)
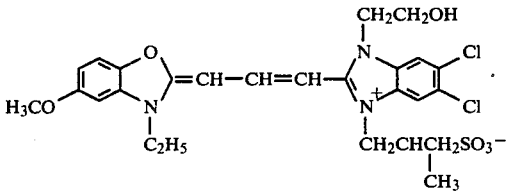
(6)
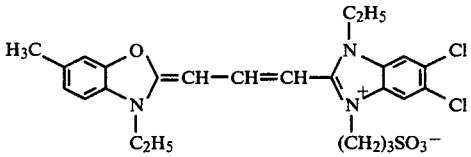
(7)
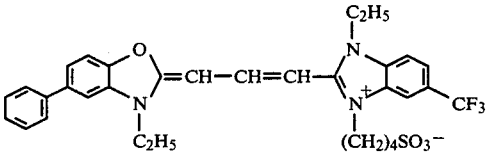
(8)
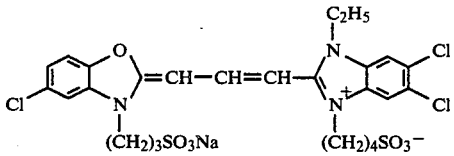
(9)
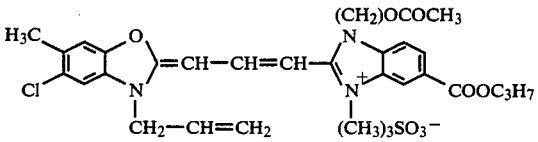
(10)
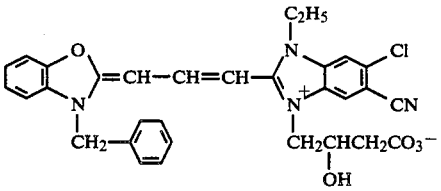
(11)
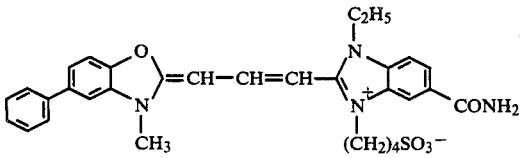
-continued
Exemplified Compounds
(12)
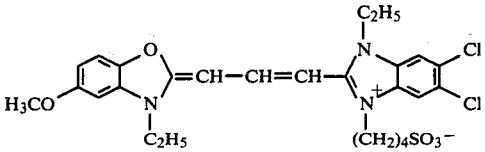
(13)
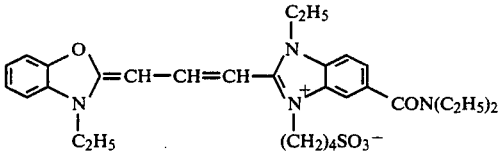
(14)
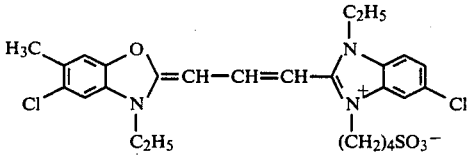
(15)
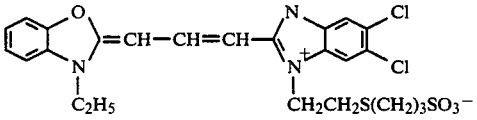
(16)
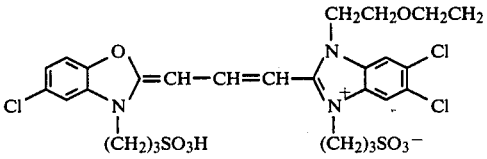
(17)
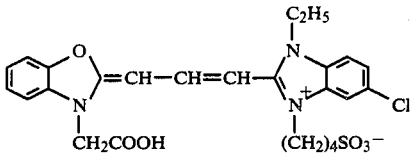
(18)
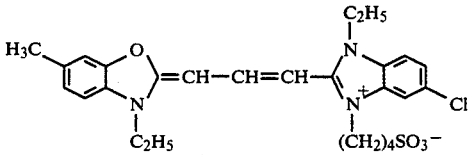
(19)
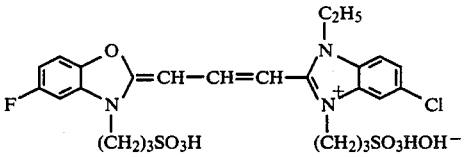
(20)
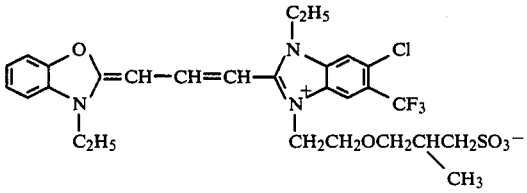

-continued
Exemplified Compounds
(21)
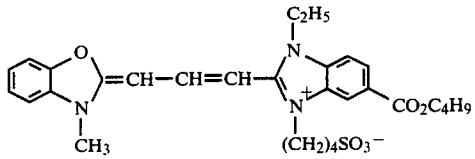
(22)
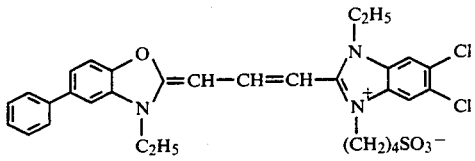
(23)
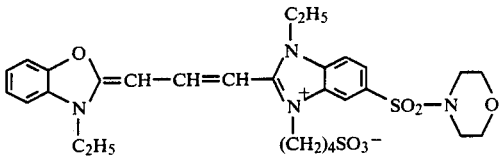
(24)
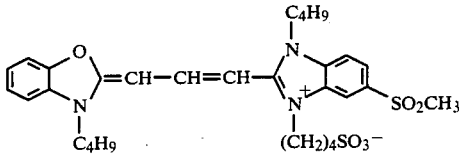
(25)
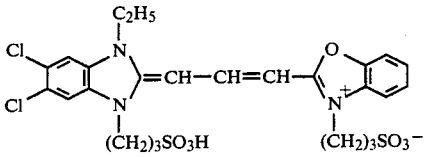
(26)
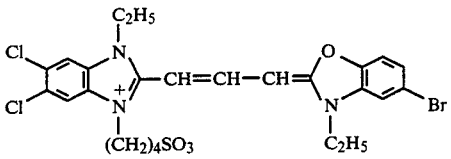
(27)
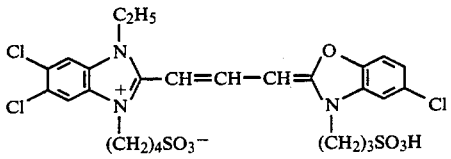
(28)
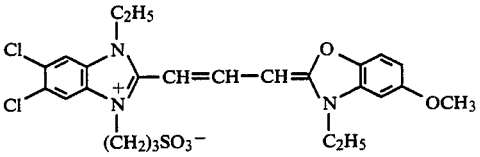
(29)
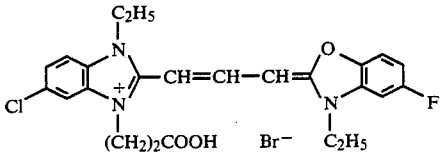
-continued
Exemplified Compounds
(30)
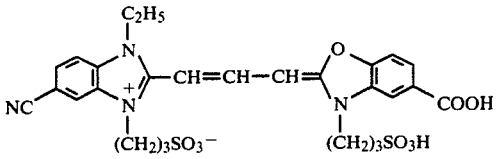
(31)
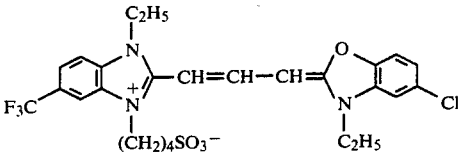
(32)
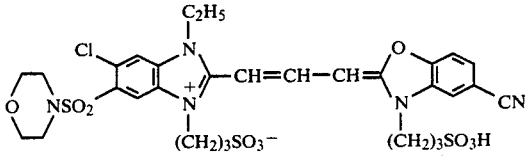
(33)
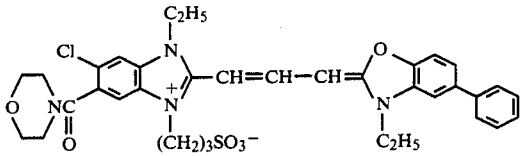
(34)
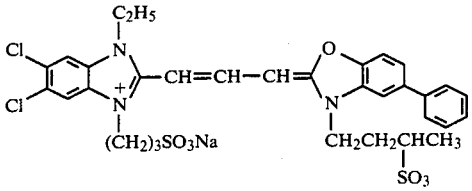
(35)
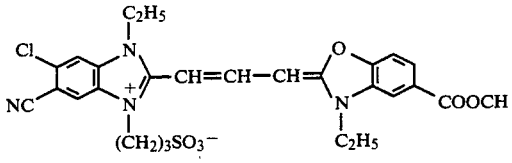
(36)
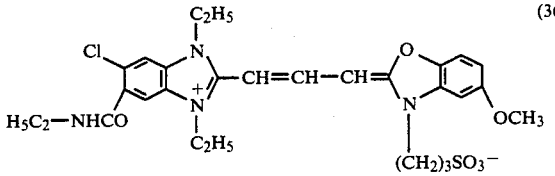
(37)
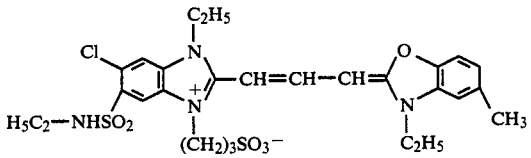
(38)
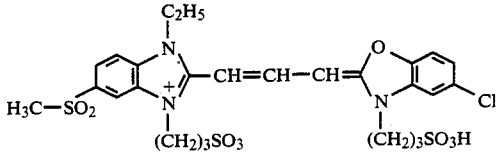

-continued

Exemplified Compounds (39)

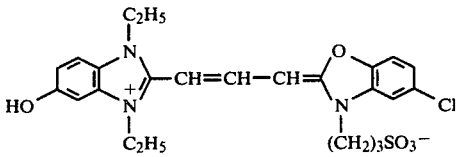

(40)

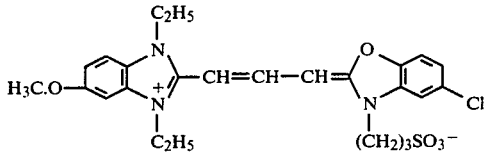

-continued

Exemplified Compounds (41)

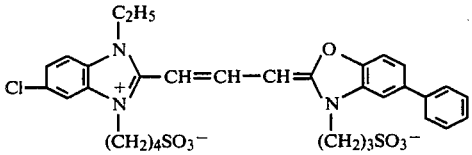

In Formula [II], the $R_6$ is a hydrogen atom, a lower alkyl or aryl group. The lower alkyl group includes methyl, ethyl, propyl, butyl, and the like groups. The aryl group includes, e.g., a phenyl group. The $R_4$ and $R_5$ each represents the same groups as those defined in the $R_1$ and $R_3$ of Formula [I]. The anion represented by the $X_2^-$ includes those exemplified in the $X_1^-$ of Formula [I].

The following are examples of those compounds having Formula [II], but it goes without saying that the invention is not limited by the examples.

(42)

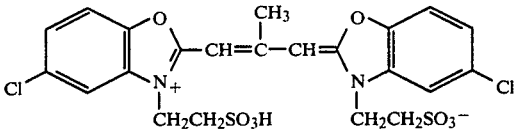

(43)

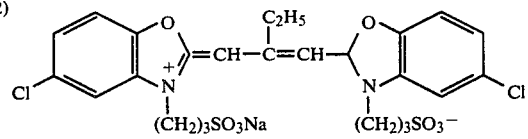

(44)

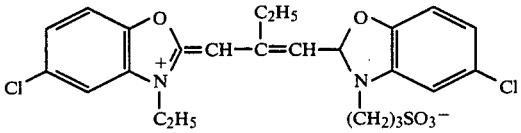

(45)

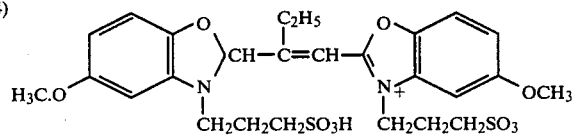

(46)

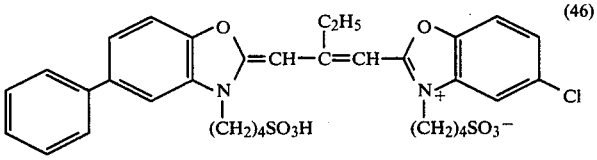

(47)

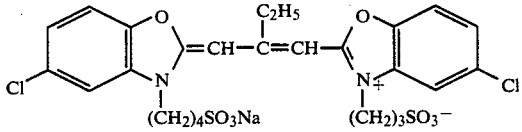

(48)

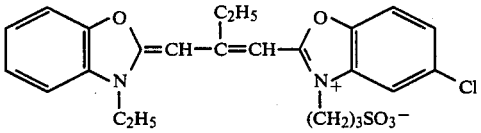

(49)

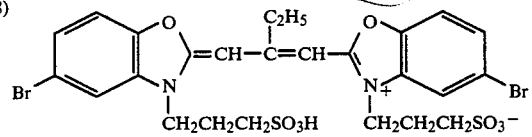

(50)

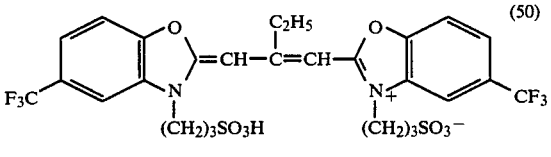

(51)

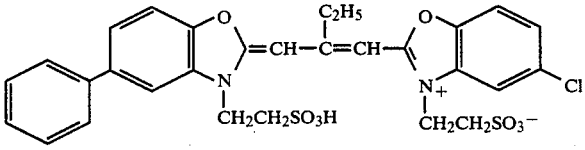

(52)

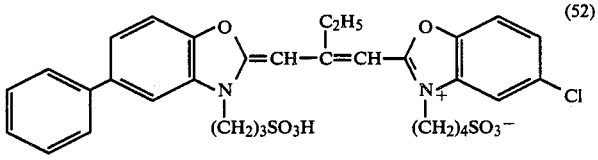

(53)

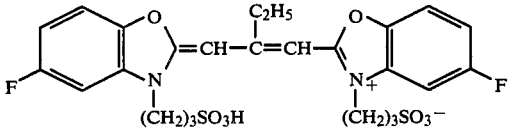

(54)

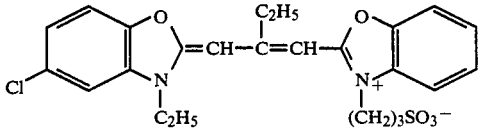

(55)

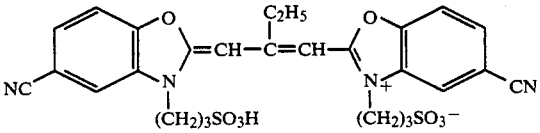

-continued
(56)
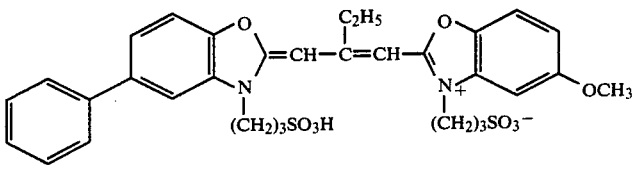
(57)
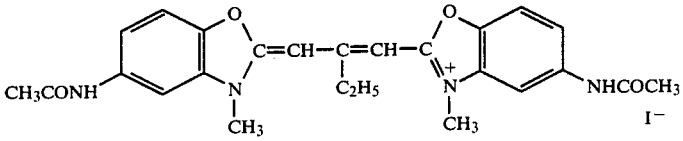
(58)
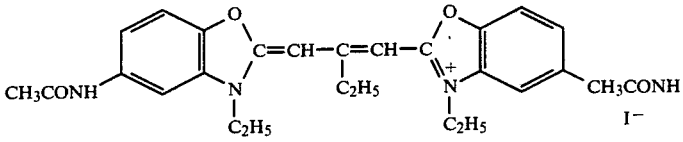
(59)
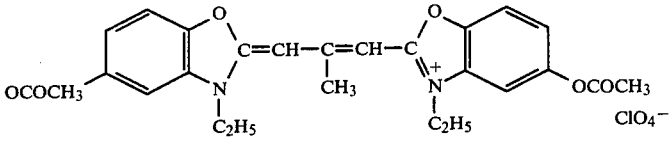
(60)
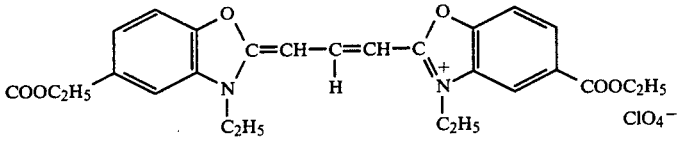
(61)
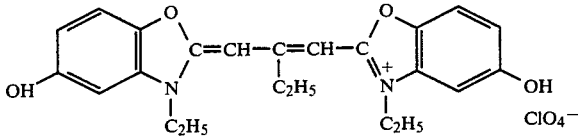
(62)
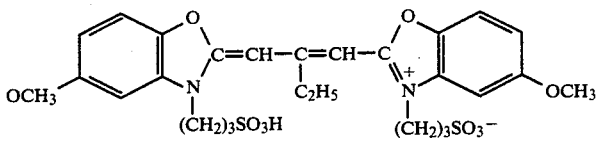
(63)
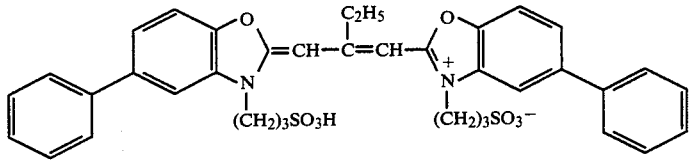
(64)
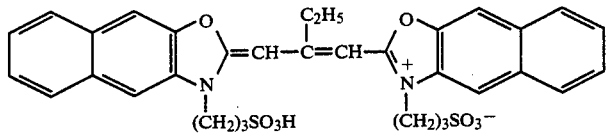
(65)
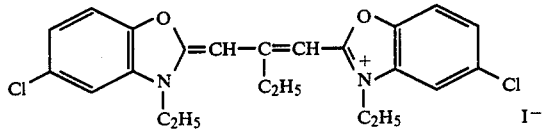
In Formula [III], the lower alkyl group represented by each of the $R_7$ and $R_9$ includes methyl, ethyl, propyl, butyl and the like groups. The substituted alkyl group includes those as defined in the $R_1$ through $R_3$ of Formula [I]. The lower alkyl group represented by each of the $R_8$ and $R_{10}$ includes those as defined in the $R_7$ and $R_9$. The hydroxyalkyl, sulfoalkyl, carboxyalkyl groups represented by each of the $R_8$ and $R_{10}$ include the corresponding groups to those as defined in the $R_1$ through $R_3$. The anion represented by the $X_3^-$ also includes the corresponding anions to those defined in the $X_1^-$ of Formula [I].

Typical examples of those compounds having the above Formula [III] are given below. The present invention is of course not limited by the examples.

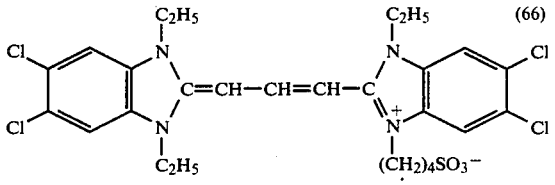
(66)

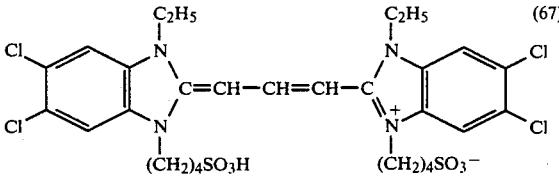
(67)

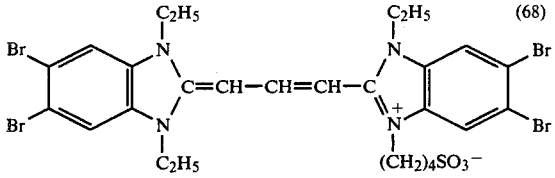
(68)

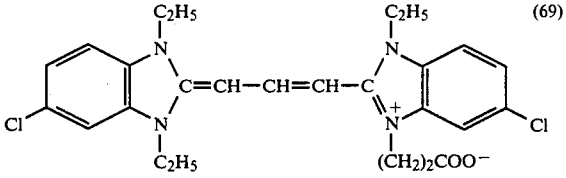
(69)

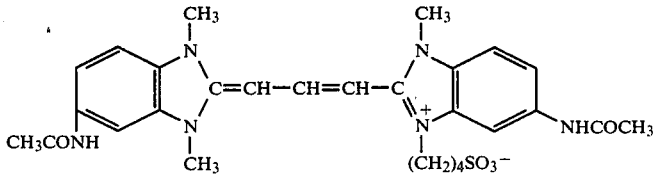
(70)

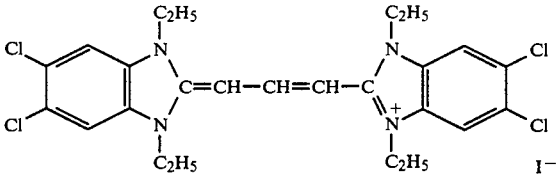
(71)

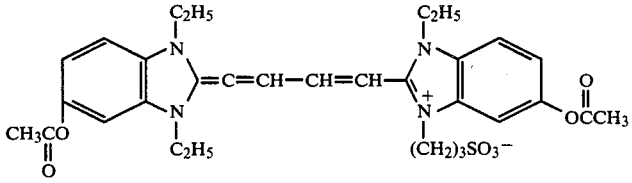
(72)

The total amount in which of any of these compounds having Formulas [I], [II] and [III] may be added is in the range of from 10 mg to 900 mg per mole of silver halide, and particularly preferably from 60 mg to 600 mg.

Methods of chemically sensitizing the grown grains include the sulfur sensitization method using sodium thionitrate, thiourea compounds, etc.; the gold sensitization method using chloroaurates, gold trichloride, etc.; the reduction sensitization method using thiourea dioxide, stannous chloride, ripening of silver, etc.; and others including the palladium sensitization method, selenium sensitization method, and the like. These methods may be used alone or in combination. In this instance, the combined use of the gold sensitization with sulfur sensitization is desirable.

The chemical sensitization may be made either by separately performing appropriate chemical sensitizations of the different silver halide emulsions to be used in the invention or by chemically sensitizing an emulsion prepared by mixing the emulsions. For the practice of this invention the former is preferred.

The silver halide emulsion to be used in this invention may to be sensitized by the selenium sensitization method in addition to the above sulfur sensitization and the like. For example, those methods using, e.g., selenourea, N,N-dimethylselenourea, etc., may be used which are described in U.S. Pat. Nos. 1,574,944 and 3,591,385; and Japanese Patent Examined Publication Nos. 13849/1968 and 15748/1969.

In the silver halide photographic light-sensitive material of this invention, two or more silver halide emulsions different in the average grain size may be coated in the form of separated individual (superposed) layers on a support or may also be mixed and coated in the form of a single layer on a support. The support to be used in this instance includes all those of the prior art; e.g., polyester film such as of polyethylene terephthalate, polyamide film, polycarbonate film, styrene film, baryta paper, synthetic high molecular material-laminated paper, and the like. The emulsion may be coated either on one side or both sides of the support. When coated on both sides, the emulsion may be coated either symmetrically or asymmetrically with respect to the support.

U.S. Pat. No. 3,923,515 describes a radiographic light-sensitive material to be both-side-emulsion-coated wherein the so-called print-through or crossover effect can be removed if a low-sensitive emulsion is coated directly on the support, and a high-sensitive emulsion layer is coated on the low-sensitive emulsion layer. The silver halide photographic light-sensitive material of this invention has no significant difference in the print-through or crossover effect between the coating of superposed layers and the coating of a single emulsion layer of mixed emulsion. An example described in the above U.S. Patent specification shows a light-sensitive material whose coated amount of silver is not less than 6 grams per $m^2$. The present invention takes a quite different construction than that described in the above U.S. Patent specification.

This invention is applicable to all types of silver halide photographic light-sensitive materials. For example, the invention is particularly suitable for high-speed black-and-white or color negative light-sensitive materials. When applying the light-sensitive material to medical radiography, for example, a fluorescent intensifying screen composed mainly of a phosphor which emits near-ultraviolet or visible rays when exposed to transmissible radiation is brought into contact with both sides of a silver halide material having on both sides thereof the emulsion of this invention, and this unit may undergo radiographic exposure. The transmissible radiation means high-energy electromagnetic waves including X-rays and gamma rays. And the fluorescent intensifying screen is an intensifying screen whose fluorescent component is comprised mainly of, e.g., calcium tungstate ($CaWO_4$) or of terbium-activated rare earth compounds.

In practicing this invention, as the hydrophilic colloid for use in dispersing silver halide grains, gelatin is suitably usable, and further, for improving the physical properties of the binder, for example, gelatin derivatives; other natural hydrophilic colloids such as albumin, casein, agar-agar, gum arabic, alginic acid and the derivatives thereof such as salts, amides, esters; starch and the derivatives thereof; cellulose derivatives such as cellulose ester, partially hydrolyzed cellulose acetate, carboxymethyl cellulose, etc.; synthetic hydrophilic resins such as polyvinyl alcohol, polyvinyl pyrolidone, acrylic and methacrylic acids and the derivatives thereof such as esters, amides; homo- and copolymers of nitriles; vinyl polymers such as vinyl ether, vinyl ester; etc., may be used.

In rapid processing in an automatic processor, the gelatin content of the silver halide photographic light-sensitive material is desirably as small as possible in order to improve its dryability. On the other hand, if the gelatin content is reduced, then its colloidality is decreased, thus making pressure marks appear on the light-sensitive material in transit by the roller transport system inside the processor. Accordingly, the amount of gelatin used in the silver halide photographic light-sensitive material of this invention is desirably in a proportion by weight of 0.4 to 0.8 to the weight of silver equivalent of the silver halide used (amount of gelatin-/amount of silver).

In practicing this invention, the silver halide grain of the light-sensitive material may have the foregoing Ir, Rh, Pt, Au ions or the like added thereto contained thereinside in the course of the growth thereof, and also may have a reduction sensitization nucleus provided thereinside by use of a low-pAg atmosphere or an appropriate reducing agent. After completion of the growth of the silver halide grain, an appropriate method may be used to produce a pAg or silver ion concentration suitable for the chemical sensitization; this can be carried out by, for example, any of those aggregation methods, noodle washing methods, etc., as described in Research Disclosure No. 17643.

The silver halide emulsion used in the silver halide light-sensitive material of this invention may contain a stabilizer or antifoggant. For this purpose any of those stabilizers or antifoggants may be used which are described in, e.g., U.S. Pat. Nos. 2,444,607, 2,716,062, 3,512,982, 3,342,596; West German Patent Nos. 1,189,380, 205,862, 211,841; Japanese Patent Examined Publication Nos. 4183/1968, 2825/1964; Japanese Patent O.P.I. Publication Nos. 22626/1975 and 25218/1975. Particularly useful compounds include 4-hydroxy-6-methyl-1,3,3a,7-tetrazaindene, 5,6-trimethylene-7-hydroxy-S-triazolo(1,5-a)pyrimidine, 5,6-tetramethylene-7-hydroxy-S-triazolo(1,5-a)pyrimidine, 5-methyl-7-hydroxy-S-triazolo(1,5-a)pyrimidine, 7-hydroxy-S-triazolo(1,5-a)pyrimidine, gallates (such as isoamyl gallate, dodecyl gallate, propyl gallate, sodium gallate, etc.), mercaptans (such as 1-phenyl-5-mercaptotetrazole, 2-mercaptobenzothiazole, etc.), benzotriazoles (such as 5-bromobenzotriazole, 4-methylbenzotriazole, etc.), benzimidazoles (such as 6-nitrobenzimidazole), and the like.

The silver halide photographic light-sensitive material of this invention may contain in the coating liquid thereof any one of usually usable photographic hardening agents such as those aldehyde-type or aziridine-type compounds as described in, e.g., PB report 19,921, U.S. Pat. Nos. 2,950,197, 2,964,404, 2,983,611, 3,271,175, Japanese Patent Examined Publication No. 40898/1971, and Japanese Patent O.P.I. Publication No. 91315/1975; those iso-oxazole-type compounds as described in, e.g., U.S. Pat. No. 331,609; those epoxy-type compounds as described in, e.g., U.S. Pat. No. 3,047,394, West German Patent No. 1,085,663, British Patent No. 1,033,518, and Japanese Patent Examined Publication No. 35495/1973; those vinylsulfone-type compounds as described in, e.g., PB report 19,920, West German Patent No.1,100,942, British Patent No. 1,251,091, Japanese Patent Application Nos. 54236/1970, 110996/1973, U.S. Patent Nos. 353,964 and 3,490,911; those acryloyl-type compounds as described in, e.g., Japanese Patent Application No. 27949/1973 and U.S. Pat. No. 3,640,720; those carbodiimide-type compounds as described in, e.g., U.S. Pat. No. 2,938,892, Japanese Patent Examined Publication No. 38715/1971, and Japanese Patent Application No. 15095/1974; and others including maleimide-type, acetylene-type, methane-sulfonate-type, triazine-type and high-molecular-type compounds. Further, the coating liquid may also contain any one of those viscosity-increasing agents as described in, e.g., U.S. Pat. No. 3,167,410 and Belgian Patent No. 558,143; gelatin plasticizers such as those polyols as described in, e.g., U.S. Pat. No. 2,960,404, Japanese Patent Examined Publication No. 4939/1968 and Japanese Patent O.P.I. Publication No. 63715/1973; those latexes as described in, e.g., U.S. Pat. No. 766,979, and French Patent No. 1,395,544 and Japanese Patent Examined Publication No. 43125/1973; and those matting agents as described in, e.g., British Patent No. 1,221,980.

In the component layer(s) of the silver halide photographic light-sensitive material of this invention any desired coating aid may be used such as saponin or those sulfosuccinic acid-type surfactants as described in, e.g., British Patent No. 548,532, Japanese Patent Application No. 89630/1972, and the like or those anionic surfactants as described in, e.g., Japanese Patent Examined Publication No. 18166/1968, U.S. Pat. No. 3,514,293, French Patent No. 2,025,688 and Japanese Patent Examined Publication No. 10247/1968.

In the silver halide photographic light-sensitive material of this invention, in order to reduce the so-called crossover effect, a dye may be used in a layer provided between the support and the emulsion layer, and in order to improve the sharpness of a produced image or to reduce a fog possibly caused by a safelight, a dye may be added to the protective layer and/or the emulsion layer of this invention, and as the dye those of all types capable of accomplishing the above purposes may be used.

In order to apply the emulsion of this invention to a color light-sensitive material, cyan, magenta and yellow color forming couplers may be combinedly incorporated into the invention's emulsions prepared separately to be red-, green- and blue-sensitive, respectively, in a procedure and with materials usually used in producing color light-sensitive materials.

Those couplers useful in this invention include open-chain methylene-type yellow couplers, pyrazolone-type magenta couplers and phenol-type or naphthol-type cyan couplers, and further colored couplers for automasking in combination with these couplers (such as split-off group-combined couplers having an azo group as the linkage group at the active site thereof), osazone-type compounds, development diffusible dye-releasing-type couplers, development inhibitor releasing-type compounds (including compounds capable of releasing a development inhibitor during the reaction thereof with the oxidized product of an aromatic primary amine developing agent and also DIR couplers forming a color dye and DIR compounds forming a colorless dye during the reaction thereof with the oxidized product of an aromatic primary amine developing agent), and the like. The incorporation of these couplers into the silver halide photographic light-sensitive material may be carried out by the application of various techniques used for couplers.

The silver halide photographic light-sensitive material of this invention may be processed in various manners. In the case of a black-and-white material, the developer to be used may be one usually used, containing a single agent or combined agents such as, e.g., hydroquinone, 1-phenyl-3-pyrazolidone, N-methyl-p-aminophenol or p-phenylenediamine and also other additives commonly used. And in the case where the light-sensitive material is for color photography use, it may be color-developed by a commonly usable color developing method.

An aldehyde hardening agent-containing developer may also be used for processing the silver halide photographic light-sensitive material of this invention. For example, a developer containing a dialdehyde such as maleic dialdehyde or glutaric aldehyde or the sodium hydrogensulfite salt thereof, or the like, may be used.

EXAMPLES

The following examples will further illustrate the present invention, but embodiments of the invention are not limited thereto.

EXAMPLE 1

The preparation of silver halide emulsions $E_1$ through $E_{16}$ will be first described, and the preparation of samples using these emulsions will be subsequently explained.

Polydisperse emulsions $E_1$ through $E_4$ were prepared as follows: 2.5 mole % silver iodide-containing silver iodobromide twin-type polydisperse emulsions $E_1$ through $E_4$ were obtained by the full ammonia orderly mixing method. The respective average grain sizes are 1.15μ, 0.95μ, 0.80μ and 0.55μ, and the $S/\bar{r}$ thereof are 0.38, 0.35, 0.32 and 0.30, respectively.

Figure 5:
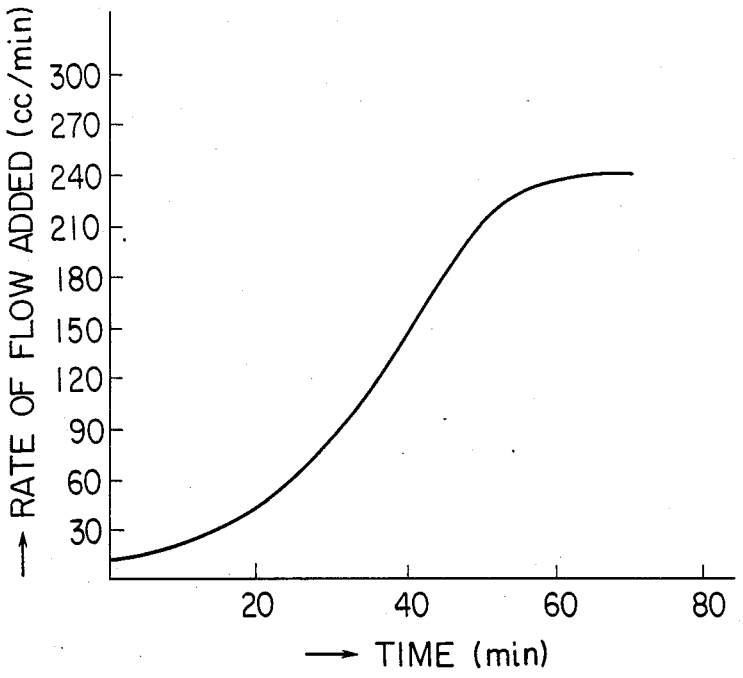
FIG. 5 is a graph showing adding the flow pattern of $Ag^+$ and $X^-$ in Example 1 of this invention.
Figure 6:
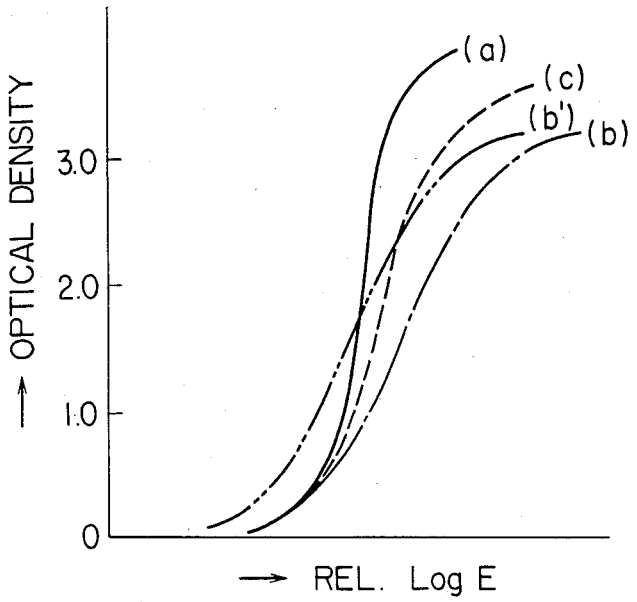
FIG. 6 is a graph showing the characteristic curve of radiographic light-sensitive materials of the high gamma type (a), the low gamma type (b) and the medium gamma type (c).

Subsequently, monodisperse emulsions $E_5$ through $E_{13}$ were obtained in the following manner:

Firstly, $E_5$ through $E_{10}$ will be explained. 2.5 mole % silver iodide-containing silver iodobromide monodisperse cubic-type emulsions and monodisperse spherical-type emulsions having an average grain size of 0.25μ were obtained with their temperature, pAg and pH controlled to be 60° C., 8 and 2, respectively, by the double-jet method. Part of each of these emulsions was used as seed crystals and was grown as follows: To an aqueous solution containing protective gelatin and, if necessary, ammonia, kept at 60° C., the seed crystal was added and further, glacial acetic acid and an aqueous KBr solution were added to adjust the pH and pAg thereof. The obtained solution was used as a mother liquid, and to this, with vigorously stirring, were added in a flow pattern as shown, in FIG. 5 a 3.2-N ammoniacal silver nitrate solution to be mixed and a halide solution by the double-jet method. In this instance, the mother liquid was adjusted to be of an ammonia concentration of 0.6N, pH 9.7 and pAg 7.6, whereby a 30 mole % silver iodide-containing silver iodobromide was grown on the seed crystal. Subsequently, with the pAg kept constant at 9.0, the pH was varied from 9 to 8 with the addition of both ammoniacal silver nitrate and potassium bromide solutions to thereby form a pure silver bromide shell.

Thus, Emulsions $E_5$ through $E_{10}$ were obtained. The average silver iodide content of each of these emulsions was about 2 mole %. The respective average grain sizes of $E_5$ through $E_{10}$ were 1.05μ, 0.95μ, 0.80μ, 0.72μ, 0.55μ and 0.35μ, and their $S/\bar{r}$ and shell's thicknesses were 0.10, 0.09, 0.08, 0.08, 0.08 and 0.08, and 0.29μ, 0.26μ, 0.22μ, 0.19μ, 0.12μ and 0.04μ, respectively. $E_{11}$ through $E_{13}$ are as follows: The above $E_6$, $E_7$ and $E_9$, after completion of the growth of the grains thereof, were ripened for 10 minutes with their pAg kept at 11.5, whereby grain-rounded emulsions were obtained and regarded as $E_{11}$, $E_{12}$ and $E_{13}$, respectively. The respective average grain sizes were 0.95μ, 0.80μ, and 0.55μ, and their $S/\bar{r}$ were 0.09, 0.08 and 0.08, respectively.

Subsequently, the seed crystals that were used for $E_5$ through $E_{13}$ were grown in the following manner to thereby obtain $E_{14}$ through $E_{16}$, respectively. That is, to a gelatin solution containing the seed crystal at 40° C. were added a 3.2 N ammoniacal silver nitrate solution and a 2.0 mole % potassium iodide solution with its pAg kept at 9.0 and with its pH varied from 9 down to 8 with the addition of the silver nitrate solution by the double-jet method. Further, to this, with its pAg at 9.0 and its pH at 8.0, were added an ammoniacal silver nitrate solution and potassium bromide solution by the double-jet method to thereby form a pure silver bromide shell. The respective average grain sizes of $E_{14}$ through $E_{16}$ were 0.95μ, 0.80μ and 0.55μ, and their $S/\bar{r}$ and shell thicknesses were 0.08, 0.07 and 0.07, and 0.02μ, 0.02μ and 0.01μ, respectively.

Each of the above emulsions was subjected to gold-sulfur sensitization treatment under the optimum condition.

The above emulsions were mixed under the combining conditions specified in Table 1, and to each of these emulsions were added fixed quantities of antifoggant, coating aid, hardening agent, etc., known to those skilled in the art, and then each of these emulsions was coated on both sides of a blue-tinted polyethylene terephthalate base so that the coating amount of silver is 50 mg/dm$^2$, whereby radiographic light-sensitive material samples were obtained. Each of these samples was put in between sheets of an intensifying screen LT-II for regular use (manufactured by Kasei Optonic), and was exposed through an aluminum wedge for 0.06 second to X-ray radiation at a tube voltage of 90 KVP and a tube current of 100 mA. Each exposed sample was processed in an automatic processor QX-1200 (manufactured by Konishiroku Photo Industry Co., Ltd.) with a developer XD-90 (produced by Konishiroku Photo Industry Co., Ltd.). The density measureme7nt of the samples was made using a PDA-65 densitometer, manufacture by Konishiroku Photo Industry Co., Ltd. From each of the obtained characteristic curves the reciprocal of the exposure X-ray dose at the point of blackened fog density plus 1.0 was found, and the speed of each sample was found in a relative value to that of Sample No.1 regarded as 100. Further, the sharpness in the shoulder and foot portions of each characteristic curve was examined by eye and graded with markings: Δ(normally usable), (much better), ΔX (normally usable or slightly poor), and X (unacceptable), as indicated in the following table. Further, the covering power (CP) in the maximum density region was found. The gelatin of each sample was decomposed by decomposition enzyme pancreatin, and put in a centrifugal separator to thereby separate the silver halide grains. An electron microscopic photo of the grains was prepared, from which the number of the grains was measured.

Figure 2:
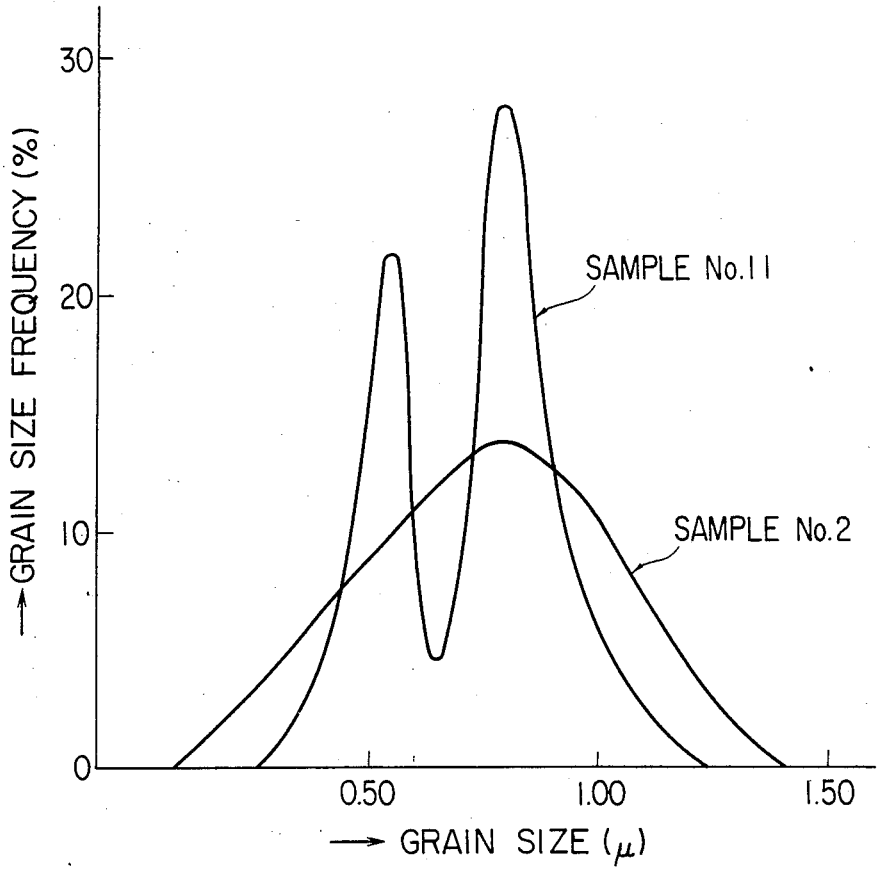
FIG. 2 and FIG. 4 show the respective grain size distribution curves of Samples No.2, No.11, No.15 and No.16 in the present invention.
Figure 3:
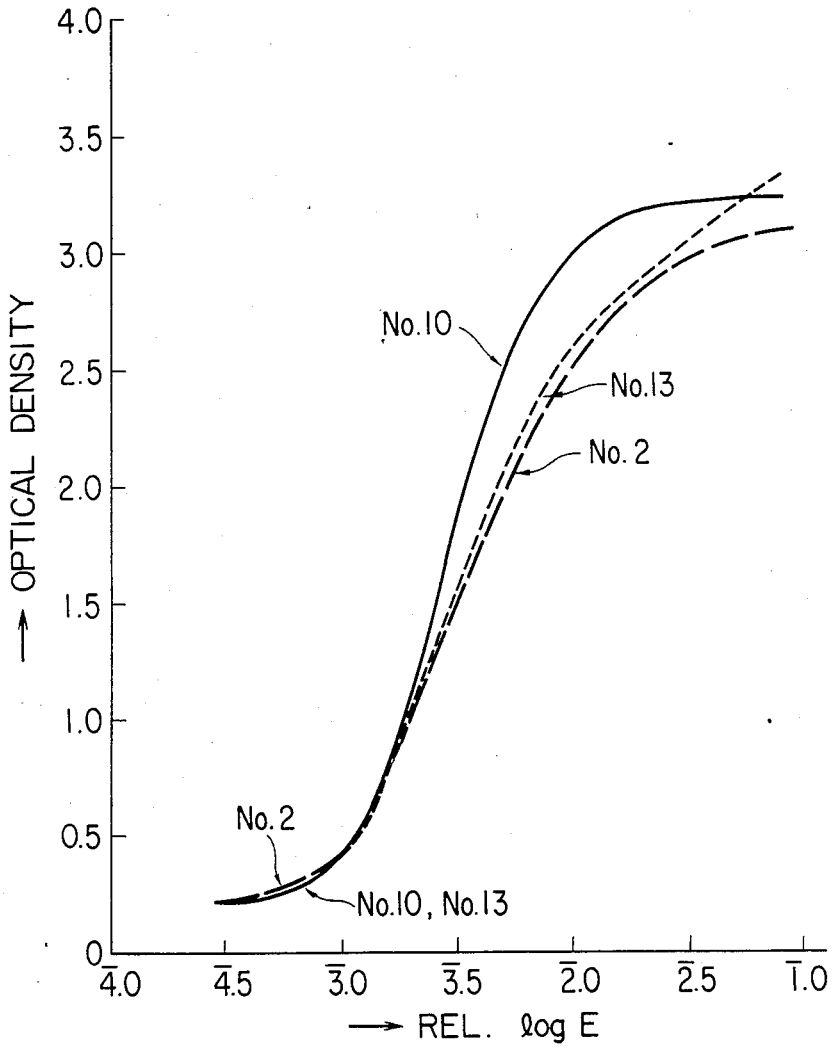
FIG. 3 is a graph showing the characteristic curves of Samples No.2, No.10 and No.13 of examples of this invention.

The results obtained are as shown in Table 1. The grain size distribution curves of Samples No. 2 and No. 11 are given in FIG. 2. The characteristic curves of Samples No. 2, No. 10 and No. 13 are shown in FIG. 3. The table shows the differences in the grain size between the A and B explained in FIG. 1, i.e., the space (μ) between the highest peak mode and the peak mode adjacent thereto, and also the ratio(%) between the A and C, and the ratio(%) between the A and B, i.e., in FIG. 1, the ratio of the height of C to that of A, and the ratio of the height of B to that of A.

TABLE 1

| Sample No. | Emulsion used (average grain size μ) | Mixing ratio by weight(%) | Difference in grain size between A & B(u) | A–C ratio (%) | A–B ratio (%) | Speed | Covering power | Sharpness (foot) | Sharpness (shoulder) | Remarks |
|---|---|---|---|---|---|---|---|---|---|---|
| 1 | E2(0.95u) | 100 | — | — | — | 100 | 50 | ΔX | X | Comparative |
| 2 | E3(0.80u) | 100 | — | — | — | 72 | 60 | ΔX | X | Comparative |
| 3 | E3(0.80), E4(0.55) | 80:20 | 0.25 | 75 | 85 | 71 | 66 | Δ | Δ | Invention |
| 4 | E7(0.80), E9(0.55) | 80:20 | 0.25 | 35 | 76 | 72 | 68 | O | Δ | Invention |
| 5 | E12(0.80), E13(0.55) | 80:20 | 0.25 | 37 | 75 | 78 | 70 | O | Δ | Invention |
| 6 | E15(0.80), E16(0.55) | 80:20 | 0.25 | 34 | 80 | 74 | 67 | O | Δ | Invention |
| 7 | E7(0.80), E11(0.35) | 80:20 | 0.45 | 8 | 33 | 62 | 75 | Δ | X | Comparative |
| 8 | E7(0.80), E8(0.72) | 80:20 | 0.08 | — | 34 | 72 | 61 | Δ | Δ | Comparative |
| 9 | E2(0.95), E3(0.80), E4(0.55) | 13:72:15 | 0.25 | 30 | 65 | 75 | 61 | Δ | Δ | Invention |
| 10 | E6(0.95), E7(0.80), E9(0.55) | 13:72:15 | 0.25 | 16 | 80 | 82 | 63 | Δ | O | Invention |
| 11 | E11(0.95), E12(0.80), E13(0.55) | 13:72:15 | 0.25 | 16 | 78 | 88 | 65 | Δ | O | Invention |
| 12 | E14(0.95), E15(0.80), E16(0.55) | 13:72:15 | 0.25 | 14 | 80 | 80 | 63 | Δ | O | Invention |
| 13 | E6 (0.95), E7(0.80), E10(0.35) | 13:72:15 | 0.45 | 12 | 45 | 70 | 67 | Δ | X | Comparative |
| 14 | E5(1.05), E7(0.80), E9(0.55) | 13:72:15 | 0.25 | 20 | 70 | 78 | 64 | Δ | O | Invention |

As is apparent from Table 1, this invention-applied Samples Nos. 3 through 6, Nos. 9 through 12, and No. 14 are excellent in the photographic speed, covering power and sharpness as compared to the comparative samples.

Sample No. 8, which, in the grain size distribution curve, shows the space between the highest peak mode and the peak mode adjacent thereto being less than 0.10μ, and Samples No. 7 and No. 13, which shows the said space being not less than 0.30μ, show almost no improvement effect on the characteristics of the non-mixture polydisperse emulsions.

EXAMPLE 2

Figure 4:
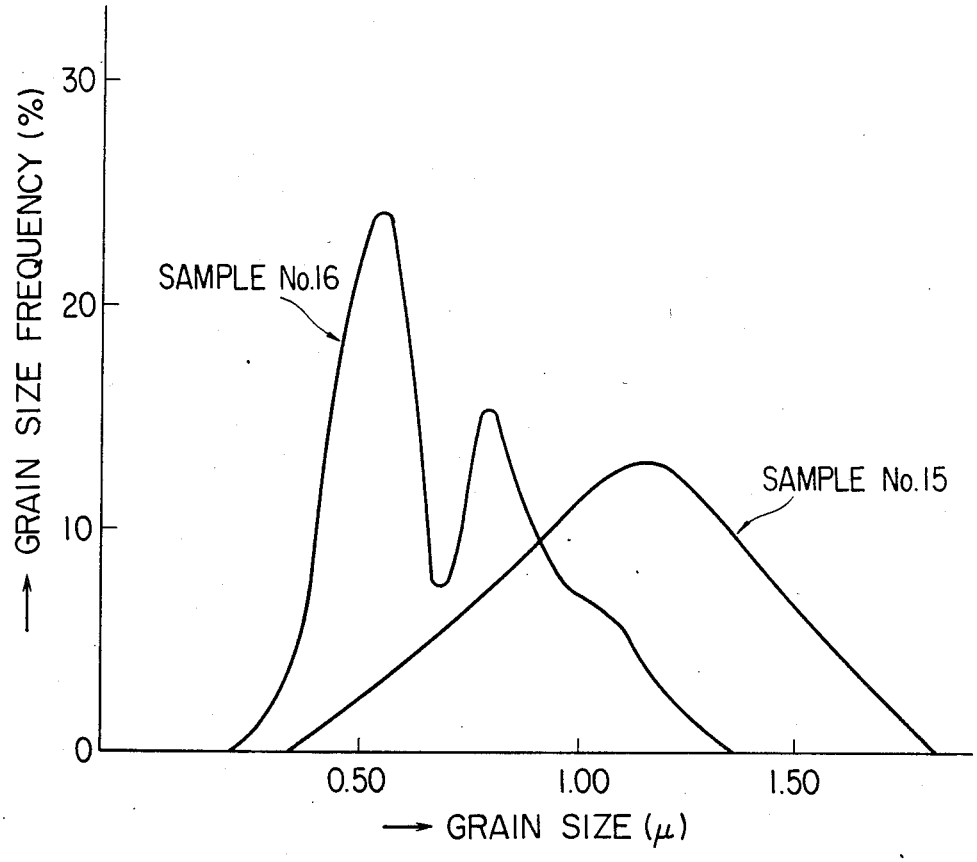

To the emulsions obtained in Example 1 were added Compounds (1), (2), (3), (4), (5), (6) and (7) as sensitizing dyes, whose formulas are given hereinafter, and then added ammonium thiocyanate, chloroauric acid and sodium thiosulfate to thus perform gold-sulfur sensitization at 55° C. The types and added quantities of the sensitizing dyes used are as given in Table 2. As is shown in Table 2, Sample No. 15, since no sensitizing dye is added thereto, is of the regular type, while Samples Nos. 16 through 26 are orthochromatically sensitized to be of the orthochromatic type. The grain size distribution curves of Samples No. 15 and No. 16 are shown in FIG. 4. Compound (1) added as a sensitizing dye is one of those having Formula [I], Compounds (2) and (3) are of Formula [II], and Compound (4) is one of those having Formula [III]. The concrete formulas of these compounds are as given hereinafter.

After the addition of ordinary stabilizer, hardening agent and coating aid, the emulsions each was coated uniformly and dried on both sides of a blue-tinted polyethylene terephthalate film base which was subbed thereon with an aqueous copolymer-dispersed liquid prepared by diluting a copolymer composed of 50% by weight glycidyl methacrylate, 10% by weight methyl acrylate, and 40% by weight butyl methacrylate so that the concentration of the copolymer is 10% by weight, whereby samples for sensitometry were obtained. The coated amount of silver of each sample was 45 mg/dm$^2$.

The sensitometry was performed to find the sharpness, covering power and grain size distribution curve of each of these samples in the same manner as in Example 1, provided that in the sensitometry the same intensifying screen for regular-type emulsion use LT-II as that used in Example 1 was used for the regular-type sample, but for the orthochromatic-type samples the intensifying screen KS for orthochromatic use (manufactured by Konishiroku Photo Industry Co., Ltd.) was used. Except for these all the procedure was performed in the same manner as in Example 1, provided that the photographic speed of each sample was expressed in a relative speed to that of Sample No. 15 regarded as 100.

Each sample was allowed to stand for about three hours in a place where the atmosphere was conditioned at 23° C./20%RH, and under this condition the sample was bent at an angle of about 280° with a radius of curvature of 2 cm. The sample, three minutes after the bending, was exposed through an aluminum wedge to X-ray radiation for 0.06 second under the condition of a voltage of 80 KV and a tube current of 100 mA, and then the exposed sample was processed in the same manner as in Example 1. The obtained samples were evaluated by eye with respect to the degree of being desensitized by pressure and graded with markings: (good), Δ(normal) and X (unacceptable). The results are shown in Table 2 and FIG. 4.

TABLE 2

| Sample No. | Emulsion used (average grain size μ) | Mixing ratio by wt.(%) | Sensitizing dye (adding q'tymg/molAgX) | Speed | Covering power | Sharpness (foot) |
|---|---|---|---|---|---|---|
| 15 | E2(1.15) | 100 | — | 100 | 41 | ΔX |
| 16 | E11(0.95), E12(0.80), E13(0.55) | 20:50:30 | Compound(1) (100 mg/molAgX) | 250 | 70 | OΔ |
| 17 | E11(0.95), E12(0.80), E13(0.55) | 20:50:30 | Compound(2) (100 mg/molAgX) | 240 | 70 | OΔ |
| 18 | E11(0.95), E12(0.80), E13(0.55) | 20:50:30 | Compound(3) (100 mg/molAgX) | 240 | 70 | OΔ |
| 19 | E11(0.95), E12(0.80), E13(0.55) | 20:50:30 | Compound(4) (100 mg/molAgX) | 240 | 70 | OΔ |
| 20 | E11(0.95), E12(0.80), E13(0.55) | 20:50:30 | Compound(5) (100 mg/molAgX) | 220 | 70 | Δ |
| 21 | E11(0.95), E12(0.80), E13(0.55) | 20:50:30 | Compound(6) (100 mg/molAgX) | 215 | 70 | Δ |
| 22 | E11(0.95), E12(0.80), E13(0.55) | 20:50:30 | Compound(7) (100 mg/molAgX) | 215 | 70 | Δ |
| 23 | E6(0.95), E7(0.80), E9(0.55) | 20:50:30 | Compound(1) (100 mg/molAgX) | 240 | 68 | OΔ |
| 24 | E14(0.95), E15(0.80), E16(0.55) | 20:50:30 | Compound(1) (100 mg/molAgX) | 235 | 67 | OΔ |
| 25 | E6(0.95), E7(0.80), E10(0.35) | 20:50:30 | Compound(1) (100 mg/molAgX) | 215 | 79 | OΔ |
| 26 | E2(1.15), E12(0.80), E13(0.55) | 20:50:30 | Compound(1) (100 mg/molAgX) | 240 | 70 | OΔ |

| Sample No. | Sharpness (shoulder) | Pressure desensitization | A-B difference in grain size(μ) | A-C ratio (%) | A-B ratio (%) | Remarks |
|---|---|---|---|---|---|---|
| 15 | ΔX | X | — | — | — | Comparative |
| 16 | O | O | 0.25 | 31 | 63 | Comparative |
| 17 | O | O | 0.25 | 31 | 63 | Invention |
| 18 | O | O | 0.25 | 31 | 63 | Invention |
| 19 | O | O | 0.25 | 31 | 63 | Invention |
| 20 | Δ | O | 0.25 | 31 | 63 | Invention |
| 21 | Δ | O | 0.25 | 31 | 63 | Invention |
| 22 | Δ | O | 0.25 | 31 | 63 | Invention |
| 23 | O | O | 0.25 | 28 | 65 | Invention |
| 24 | O | O | 0.25 | 27 | 66 | Invention |
| 25 | ΔX | O | 0.45 | 5 | 17 | Comparative |
| 26 | O | O | 0.25 | 36 | 70 | Invention |

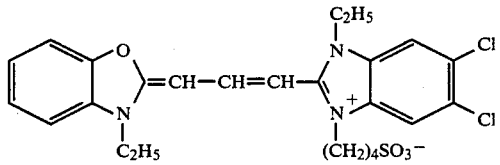

Compound (1)

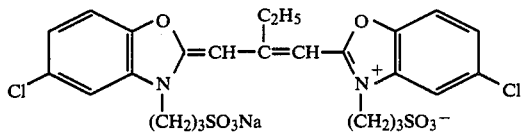

Compound (2)

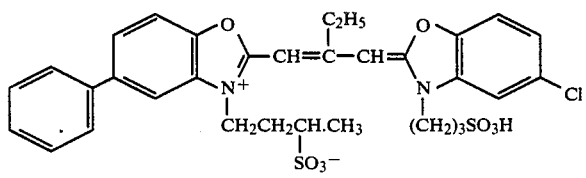

Compound (3)

-continued

Compound (4)

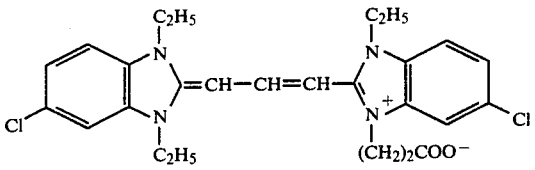

Compound (5)

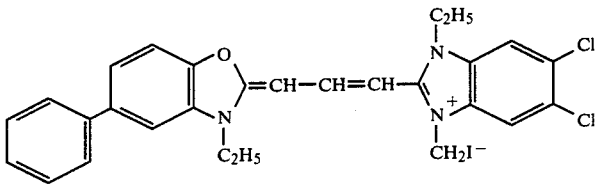

Compound (6)

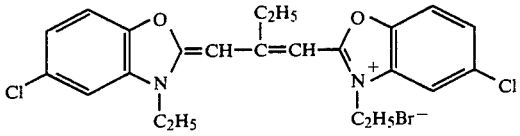

Compound (7)

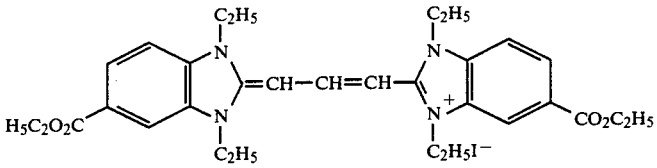

As is apparent from Table 2, the samples of this invention are excellent in any of the photographic speed, covering power, sharpness and pressure-desensitization characteristics as compared to the comparative samples.

EXAMPLE 3

As will be described below, six different emulsions I-1 through I-6 were prepared.

Firstly, by the orderly mixing method a 2.0 mole % silver iodide-containing silver iodobromide polydisperse emulsion (I-1) ($S/\bar{r}=0.37$) was obtained. Emulsion I-2 was prepared in the following procedure:

To an aqueous gelatin solution were added a 2.0 mole % potassium iodide-containing potassium bromide solution and an ammoniacal silver nitrate solution with the flow rate thereof being gradually increased by the double-jet method, whereby a 1.05 μm silver iodobromide cubic crystal-type monodisperse emulsion was obtained, and to this were further added an ammoniacal silver nitrate solution and a potassium bromide solution by the double-jet method to thereby cover the emulsion grain with a pure silver bromide shell. The thickness of the shell layer was 0.10μ. During this period, the pAg was kept at 9.0, while the pH was gradually lowered from 9.0 to 8.0. By doing this, a 1.25 μm average grain size-having cubic crystal-type monodisperse emulsion I-2-2 ($S/\bar{r}=0.09$) was obtained. And also, in the same manner as that of Emulsion I-2-2, a 1.65 μm average grain size-having cubic crystal-type monodisperse emulsion I-2-1($S/\bar{r}=0.09$) and a 0.65 μm average grain size-having cubic crystal-type monodisperse emulsion I-3-1 ($S/\bar{r}=0.07$) were obtained. This Emulsion I-2-1 and the above Emulsion I-2-2 were mixed in a proportion of 10:90 as shown in the following table, whereby Emulsion Sample I-2 was obtained.

Subsequently, the above Emulsions I-2-2 and I-3-1 were mixed in a proportion of 75:25 as shown in the following table, whereby Emulsion Sample I-3 was obtained.

Next, Emulsions I-4 through I-6 were obtained as follows:

A 0.3 μm average grain size-having 20 mole % silver iodide-containing silver iodobromide monodisperse cubic crystal-type emulsion was obtained with its temperature, pAg and pH being controlled to 60° C., 8 and 2.0, respectively, by the double-jet method. The produced degree of the twin grains in this emulsion was found out to be not more than 1% by the number of grains from an electron microscopic photo of the grains.

Part of this emulsion was used as seed crystals, which were then grown in the following manner:

The seed crystals were dissolved into 8.5 liters of an aqueous solution, kept at 40° C., containing gelatin and, if necessary, ammonia, and the pH of the solution was adjusted by use of glacial acetic acid.

Figure 7:
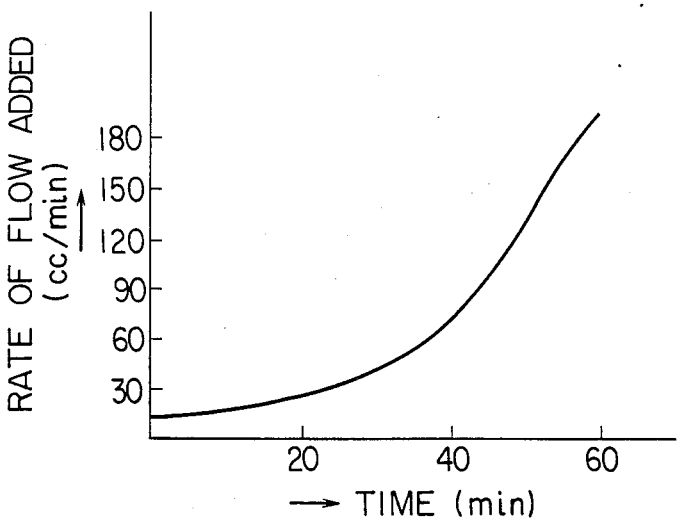
FIG. 7 is a graph showing adding the flow pattern of Example 3.

This solution was used as a mother liquid, and to this were added a 3.2N ammoniacal silver nitrate ion aqueous solution and an aqueous halide ion solution in a flow pattern as shown in FIG. 7 by the double-jet method, and the liquid was stirred and mixed.

In this instance, the mother liquid's ammonia concentration was controlled to 0.6N, pH to 9.7 and pAg to 7.6, thereby localizing 30 mole % silver iodide inside the grain.

Subsequently, the pAg was kept at 9.0 constant, and the pH was varied in proportion to the adding quantity of the ammoniacal silver ion from 9 down to 8 to thereby form a pure silver bromide shell. Further, for the final three minutes of the growth of the grains the ripening of the emulsion was performed with its pAg controlled to 11.5 to thereby round the grain form.

Thus, six different monodisperse emulsions I-4-1 through

I-6-3 were prepared as shown in Table 3. The respective $S/\bar{r}$ values of these emulsions are: I-4-1=0.09, I-4-

2=0.08, I-4-3=0.08, I-6-1=0.09, I-6-2=0.08 and I-6-3=0.08.

The three Emulsions I-4 through I-6 are ones prepared, in the same way as in the foregoing Emulsion I-2, by mixing the three intra-high-iodide-type monodisperse emulsions different in average grain size; that is, Emulsions I-4 and I-5 were obtained by mixing the 0.90μ-average-grain-size Emulsion I-4-1, the 0.70μ Emulsion I-4-2 and the 0.35μ Emulsion I-4-3 in proportions of 9:73:18 and 13:67:20, respectively; and Emulsion I-6 was obtained by mixing the 0.95μ-average-grain-size Emulsion I-6-1, the 0.80μ Emulsion I-6-2 and the 0.50μ Emulsion I-6-3 in a proportion of 22:48:30, respectively. The compositions of these samples are listed in the following Table 3.

TABLE 3

| Em No. | Average grain size of emulsion $\bar{r}$ (μ) | | | Mixing ratio (%) | Added dye |
|---|---|---|---|---|---|
| I-1 | 1.15 | | | 100 | — |
| I-2 | (I-2-1) 1.65 | | (I-2-2) 1.25 | 10:90 | — |
| I-3 | (I-2-2) 1.25 | | (I-3-1) 0.65 | 75:25 | — |
| I-4 | (I-4-1) 0.90 | (I-4-2) 0.70 | (I-4-3) 0.35 | 9:73:18 | (1) |
| I-5 | (I-4-1) 0.90 | (I-4-2) 0.70 | (I-4-3) 0.35 | 13:67:20 | (2) |
| I-6 | (I-6-1) 0.95 | (I-6-2) 0.80 | (I-6-3) 0.50 | 22:48:30 | (3) |

To the thus obtained Emulsions I-4-1 through I-4-3 and I-6-1 through I-6-3 (i.e., the emulsions constituting Emulsions I-4 through I-6) were added the following Compounds (1), (2) and (3) as sensitizers, and then added ammonium thiocyanate, chloroauric acid, and hypo, thus performing gold-sulfur sensitization. The other emulsions were gold-sulfur sensitized likewise but no sensitizing dyes were added thereto. Therefore, Samples I-4 through I-6 are ones orthochromatically sensitized to be of the orthochromatic type, but the others are of the regular type. Compounds (1) added as sensitizing dye is one of those having Formula [I], Compound (2) is of Formula [II], and Compound (3) is of Formula [III]. The respective formulas of these compounds are as follows:

(Compounds of the invention)

Compound (1)

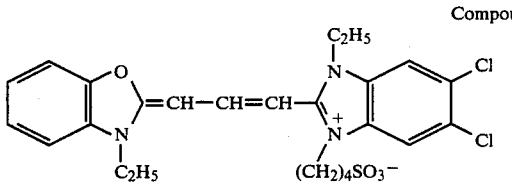

Compound (2)

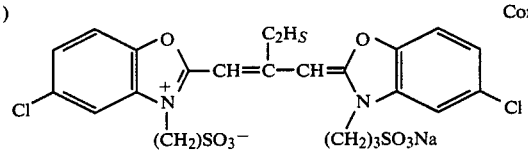

Compound (3)

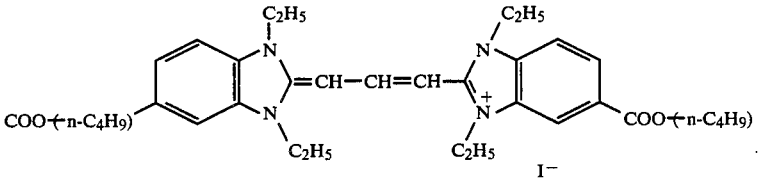

After adding ordinary stabilizer, hardening agent and coating aid to each of the emulsions, each emulsion was coated uniformly and dried on both sides of a polyethylene terephthalate film base which was subbed thereon with an aqueous polymer-dispersed liquid obtained by diluting a copolymer composed of three monomers, 50% by weight glycidyl methacrylate, 10% by weight methyl acrylate and 40% by weight butyl methacrylate, whereby samples for sensitometry were obtained.

After that, Samples I-1 through I-3, with a fluorescent screen NS (for regular emulsion use), manufactured by Konishiroku Photo Industry Co., Ltd., and Samples I-4 through I-6, with a fluorescent screen KS (for orthochromatic emulsion use), manufactured by the same company, were each exposed through an aluminum wedge to X-ray radiation under the condition of a tube voltage of 90 KV and a tube current of 50 mA, and then processed for 90 seconds in a XD-90 developer solution by an automatic processor QX-1200, manufactured by Konishiroku Photo Industry Co., Ltd., and thus sensitometric curves were obtained. The results are shown in Table 4, wherein the exposure latitudes are expressed with difference in exposure (in logarithm) between the specified optical densities.

EXAMPLE 4

The same samples as those used in Example 3 were used and evaluated with respect to the sharpness thereof. The evaluation of the sharpness was made with values obtained in the 1.0, 1.5 and 2.0 lines/mm of MTF curves. The measurement of MTF was made in the manner that a 0.8–10 lines/mm MTF square wave chart made of lead is brought into contact with the back of the fronside fluorescent screen sheet, and X-ray irradiation was made upon each sample so that the total density on both sides of the part not shaded by the lead square wave pattern (i.e., the background density) is 1.0.

After that, each sample was processed in the same way as in Example 1. The obtained square wave pattern image on the sample was measured using a Sakura Microdensitometer M-5 (manufactured by Konishiroku Photo Industry Co., Ltd.) by scanning in the direction perpendicular to the square wave. In addition, regarding the aperture size used in this instance, the dimension in the direction parallel with the square wave is 230 μm, and that in the direction perpendicular thereto is 25μ, and the magnification is 100x. The results are shown in Table 4.

EXAMPLE 5

Each of the same samples as those used in Example 3 was placed for about two hours in a place conditioned at 23° C./35% RH and under this condition the sample was bent at an angle of about 280° with a radius of curvature of 2 cm to thereby measure the pressure-desensitization characteristic.

The sample, three minutes after the bending, was exposed through an aluminum wedge to X-ray radiation for 0.06 second under the condition of a tube voltage of 80 KV and a tube current of 100 mA, and then processed in the same way as in Example 3.

The degree of the obtained sample being desensitized by pressure was evaluated by eye, and the graininess and the degree of the image deterioration caused by the rapid processing at a high pH and high temperature also were evaluated by eye.

The evaluation by eye was made in the manner of grading 1 through 5 in the order from better to worse for each of the pressure-desensitization, graininess and image quality affected by the rapid processing. In the evaluation, the grade 1 is the best, and the larger the grade number the worse. The results obtained in the above also are shown in Table 4.

TABLE 4

| Sample No. | Gamma 1 D = 0.05–0.30 | Gamma 2 D = 0.5–1.5 | Gamma 3 D = 2.0–3.0 | Exp. latitude D = 0.05–0.30 | Exp. latitude D = 2.0–3.0 | MTF 1.0 | MTF 1.5 | MTF 2.0 | Pressure desensitization | Graininess | Image quality by hi-pH, hi-temp rapid processing |
|---|---|---|---|---|---|---|---|---|---|---|---|
| I-1 | 0.74 | 2.42 | 2.93 | 0.37 | 0.30 | 0.66 | 0.49 | 0.39 | 2 | 2 | 1 |
| I-2 | 0.57 | 2.91 | 3.23 | 0.53 | 0.33 | 0.69 | 0.52 | 0.42 | 2 | 4 | 4 |
| I-3 | 0.89 | 2.99 | 1.92 | 0.26 | 0.58 | 0.68 | 0.53 | 0.43 | 2 | 2 | 3 |
| I-4 | 0.45 | 2.86 | 1.59 | 0.54 | 0.65 | 0.73 | 0.58 | 0.46 | 1 | 1 | 1 |
| I-5 | 0.56 | 2.72 | 1.65 | 0.50 | 0.60 | 0.70 | 0.56 | 0.46 | 1 | 1 | 1 |
| I-6 | 0.52 | 2.91 | 2.23 | 0.48 | 0.62 | 0.70 | 0.54 | 0.44 | 1 | 1 | 1 |

As is apparent from Table 4, each of Samples I-4 through I-6, meeting the requirements of the present invention, shows a high sharpness, a wide exposure latitude in the high-density region as well as in the low-density region, and little image quality deterioration by high-pH, high-temperature rapid processing.

Thus, the use of any sample corresponding to the examples of this invention enables one to obtain satisfactory results accomplishing the foregoing objects.

What is claimed is:

1. A silver halide photographic light-sensitive material which comprises a support having thereon a silver halide emulsion layer comprising silver halide grains having a grain-size distribution curve comprising not less than two peaks of which, in the mode form, the highest peak mode and another peak mode adjacent thereto stand leaving a space of not less than 0.10 and less than 0.30 therebetween;

said siver halide emulsion being orthochromatically sensitized with a dye-sensitizer selected from the group consisting of the compounds of the Formulas (I), (II) and (III) below:

Formula [I]

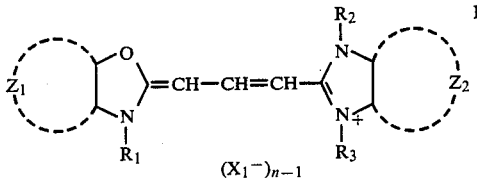

wherein $R_1$, $R_2$ and $R_3$ each is a substituted or unsubstituted alkyl, alkenyl or aryl group, provided that at least one of $R_1$ and $R_3$ is a sulfoalkyl or carboxyalkyl group; $X_1^-$ is an anion; $Z_1$ and $Z_2$ each is a group of nonmetallic atoms necessary to complete a substituted or unsubstituted benzene ring; and n is an integer of 1 or 2, provided than n is 1 when an intramolecular salt is formed;

Formula [II]

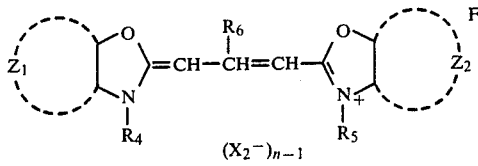

wherein $R_4$ and $R_5$ each is a substituted or unsubstituted alkyl, alkenyl, or aryl group, provided that at least one of the $R_4$ and $R_5$ is a sulfoalkyl or carboxyalkyl group; $R_6$ is a hydrogen atom, a lower alkyl or aryl group; $X_2^-$ is an anion; $Z_1$ and $Z_2$ each is a group of nonmetallic atoms necessary to complete a substituted or unsubstituted benzene ring; and n is 1 or 2, provided that n is 1 when an intramolecular salt is formed;

Formula [III]

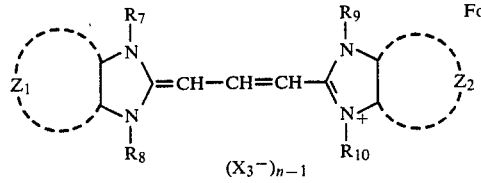

wherein $R_7$ and $R_9$ each is a substituted or unsubstituted lower alkyl group; $R_8$ and $R_{10}$ each is a lower alkyl, hydroxyalkyl, sulfoalkyl or carboxyalkyl group; $X_3^{31}$ is an anion; $Z_1$ and $Z_2$ each is a group of nonmetallic atoms necessary to complete a benzene ring; and n is 1 or 2, provided that n is 1 when an intramolecular salt is formed.

2. The silver halide photographic light-sensitive material of claim 1, wherein said space between said highest peak mode and said adjacent peak mode is from 0.10μ to 0.25μ.

3. The silver halide photographic light-sensitive material of claim 1, wherein said highest peak mode and said adjacent peak mode form a trough therebetween, said trough having a frequency of from 90% to 5% of that of said highest peak mode.

4. The silver halide photographic light-sensitive material of claim 1, wherein the proportion by frequency of said highest peak mode to said adjacent peak mode is from 1:1 to 1:0.3.

5. The silver halide photographic light-sensitive material of claim 1, wherein said silver halide photographic light-sensitive material is of a characteristic curve by which the gamma ($\gamma_1$) formed between the optical density points 0.05 and 0.30 is from 0.30 to 0.65, the gamma ($\gamma_2$) formed between the optical density points 0.50 and 1.50 is from 2.7 to 3.3, and the gamma ($\gamma_3$) formed between the optical density points 2.00 and 3.00 is from 1.5 to 2.5.

6. The silver halide photographic light-sensitive material of claim 1, wherein said silver halide emulsion layer comprises said silver halide grains not less than 80% of which are regular-form grains.

7. The silver halide photographic light-sensitive material of claim 1, wherein said silver halide emulsion layer comprises monodisperse silver halide grains at least 95% of which are in the grain-size range of the average grain size thereof ±40%.

8. The silver halide photographic light-sensitive material of claim 1, wherein said silver halide emulsion layer contains said silver halide grains each comprising thereinside a not less than 20 mole % silver iodide-localized part.

9. The silver halide photographic light-sensitive material of claim 8, wherein said silver halide emulsion layer comprises core/shell-type silver halide grains each comprising said localized part as a core and a shell whose thickness is not less than 0.01$\mu$ and the silver iodide content of which is less than that of said core.

10. The silver halide photographic light-sensitive material of claim 7, wherein said silver halide emulsion layer comprises not more than five different-in-the-average-grain-size monodisperse silver halide grains.

11. The silver halide photographic light-sensitive material of claim 1, wherein said dye-sensitizer (I) is present, wherein each of $R_1$, $R_2$ and $R_3$ is methyl, ethyl, n-propyl, butyl, vinylmethyl, 2-hydroxyethyl, 4-hydroxyethyl, 2-acetoxyethyl, 3-acetoxybutyl, 2-carboxyethyl, 3-carboxypropyl, 2-(2-carboxyethoxy)ethyl, 2-sulfoethyl, 3-sulfopropyl, 3-sulfobutyl, 4-sulfobutyl, 2-hydroxy-3-sulfopropyl, butenyl, octenyl, oleyl, phenyl or carboxyphenyl, provided at least one of the $R_1$, $R_2$ and $R_3$ is 2-sulfoethyl, 3-sulfopropyl, 3-sulfobutyl, 4-sulfobutyl, 2-hydroxy-3-sulfopropyl, 2-carboxyethyl, 3-carboxypropyl or 2-(2-carboxyethyoxy)ethyl, and $X_1$ is a chlorine ion, bromine ion, iodine ion, thiocyanic acid ion, sulfuric acid ion, perchloric acid ion, p-toluene-sulfuric acid ion or ethylsulfuric acid ion.

12. The silver halide photographic light-sensitive material of claim 11, wherein said dye-sensitizer is

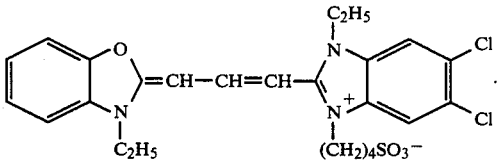

13. The silver halide photographic light-sensitive material of claim 1, wherein said dye-sensitizer (II) is present, wherein each of $R_4$ and $R_5$ is selected from the group consisting of methyl, ethyl, n-propyl, butyl, vinylmethyl, 2-hydroxyethyl, 4-hydroxyethyl, 2-acetoxyethyl, 3-acetoxybutyl, 2-carboxyethyl, 3-carboxypropyl, 2-(2-carboxyethoxy)ethyl, 2-sulfoethyl, 3-sulfopropyl, 3-sulfobutyl, 4-sulfobutyl, 2-hydroxy-3-sulfopropyl, butenyl, octenyl, oleyl, phenyl and carboxyphenyl, provided at least one of $R_4$ and $R_5$ is 2-sulfoethyl, 3-sulfopropyl, 3-sulfobutyl, 4-sulfobutyl, 2-hydroxy-3-sulfopropyl, 2-carboxyethyl, 3-carboxypropyl or 2-(2-carboxyethoxy)ethyl, and $R_6$ is a hydrogen atom, methyl, ethyl, propyl, butyl or phenyl and $X_2$ is a chlorine ion, bromine ion, iodine ion, thiocyanic acid ion, sulfuric acid ion, perchloric acid ion, p-toluene-sulfuric acid ion or ethylsulfuric acid ion.

14. The silver halide photographic light-sensitive material of claim 13, wherein said dye-sensitizer is

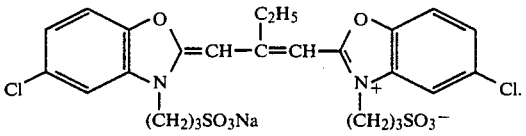

15. The silver halide photographic light-sensitive material of claim 13, wherein said dye-sensitizer is

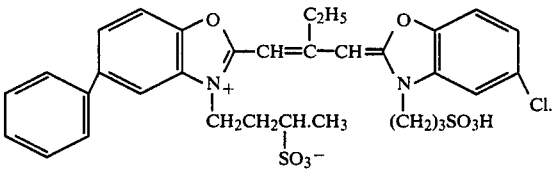

16. The silver halide photographic light-sensitive material of claim 13, wherein said dye-sensitizer is

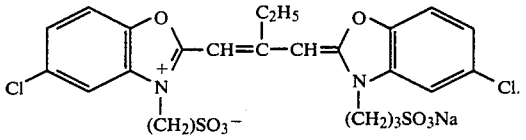

17. The silver halide photographic light-sensitive material of claim 1, wherein said dye-sensitizer (III) is present, wherein each of $R_7$ and $R_9$ is methyl, ethyl, propyl, butyl, vinylmethyl, 2-hydroxyethyl, 4-hydroxyethyl, 2-acetoxyethyl, 3-acetoxybutyl, 2-carboxyethyl, 3-carboxypropyl, 2-(2-carboxyethoxy)ethyl, 2-sulfoethyl, 3-sulfopropyl, 3-sulfobutyl, 4-sulfobutyl or 2-bydroxy-3-sulfopropyl, each of $R_8$ and $R_{10}$ is methyl, ethyl, propyl, butyl, 2-hydroxyethyl, 4-hydroxyethyl and $X_3$ is a chlorine ion, bromine ion, iodine ion, thiocyanic acid ion, sulfuric acid ion, perchloric acid ion, p-toluene-sulfuric acid ion or ethylsulfuric acid ion.

18. The silver halide photographic light-sensitive material of claim 17, wherein said dye-sensitizer is

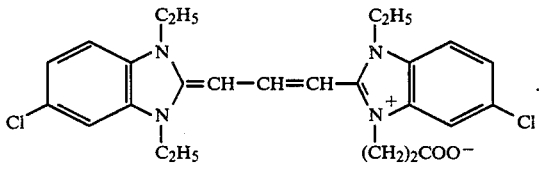

19. The silver halide photographic light-sensitive material of claim 17, wherein the dye-sensitizer is

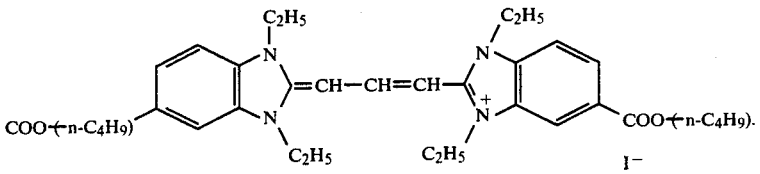

20. The silver halide photographic light-sensitive material of claim 1, wherein said dye-sensitizer is present in the range of from 40 mg to 900 mg per mole of silver halide.

21. The silver halide photographic light-sensitive material of claim 20, wherein said dye-sensitizer is present in the range of from 60 mg to 600 mg per mole of silver halide.

22. The silver halide photographic light-sensitive material of claim 3, wherein said trough has a frequency of from 80% to 10% of that of said highest peak mode.

23. The silver halide photographic light-sensitive material of claim 4, wherein said proportion by frequency of said highest peak mode to said adjacent peak mode is from 1:0.9 to 1:0.4.

24. The silver halide photographic light-sensitive material of claim 7, wherein at least 95% of the grain-size range of the average grain size thereof is ±30%.

* * * * *